US009302475B2

(12) United States Patent
Nitta et al.

(10) Patent No.: US 9,302,475 B2
(45) Date of Patent: Apr. 5, 2016

(54) INK JET HEAD DRIVING DEVICE

(71) Applicant: TOSHIBA TEC KABUSHIKI KAISHA, Shinagawa-ku, Tokyo (JP)

(72) Inventors: Noboru Nitta, Shizuoka-ken (JP); Teruyuki Hiyoshi, Shizuoka-ken (JP); Mamoru Kimura; Tomohisa Yoshimaru, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/973,116

(22) Filed: Aug. 22, 2013

(65) Prior Publication Data

US 2014/0111570 A1 Apr. 24, 2014

(30) Foreign Application Priority Data

Aug. 27, 2012 (JP) ..... 2012-186373

(51) Int. Cl.
*B41J 29/38* (2006.01)
*B41J 2/045* (2006.01)

(52) U.S. Cl.
CPC ..... *B41J 2/04588* (2013.01); *B41J 2/0451* (2013.01); *B41J 2/04508* (2013.01); *B41J 2/04541* (2013.01); *B41J 2/04573* (2013.01); *B41J 2/04581* (2013.01)

(58) Field of Classification Search
CPC ..... B41J 2/04; B41J 2/045; B41J 2/04501–2/04591
USPC ..... 347/9–11, 6, 12, 19
See application file for complete search history.

(56) References Cited

U.S. PATENT DOCUMENTS 5,729,259 A 3/1998 Gotoh et al.
5,914,731 A * 6/1999 Yano et al. ..... 347/9
(Continued)

FOREIGN PATENT DOCUMENTS

CN 1749012 3/2006
CN 101045381 10/2007
(Continued)

OTHER PUBLICATIONS

Office Action for Japanese Patent Application No. 2012-186373 Dated Jul. 1, 2014, 6 pgs.
(Continued)

*Primary Examiner* — Jannelle M Lebron
(74) *Attorney, Agent, or Firm* — Amin, Turocy & Watson, LLP

(57) ABSTRACT

A driving device of an ink jet head including a plurality of ejection channels, including a plurality of driving waveform generation portions that are provided which respectively correspond to the plurality of ejection channels, a random number generation portion that generates a random number, and a connection portion. The driving waveform generation portions receive printing data and correction data, generate a driving signal of the ejection channels on the basis of the received printing data, correct a waveform of the driving signal by using the received correction data, and then output the corrected waveform to the correction data and to the corresponding ejection channels. The connection portion connects the random number generation portion of the driving waveform generation portions such that a random number is supplied to each of the driving waveform generation portions as correction data having a value independent for each of the driving waveform generation portions.

15 Claims, 15 Drawing Sheets

(56) References Cited

U.S. PATENT DOCUMENTS

| | | | | |
|---|---|---|---|---|
| 5,966,313 | A | 10/1999 | Sakamoto | |
| 5,969,729 | A * | 10/1999 | Erickson et al. | 347/9 |
| 6,386,666 | B1 | 5/2002 | Takamura et al. | |
| 6,616,258 | B2 * | 9/2003 | Maeda | 347/12 |
| 6,698,861 | B1 | 3/2004 | Drake | |
| 7,063,400 | B2 * | 6/2006 | Du et al. | 347/9 |
| 7,270,712 | B2 * | 9/2007 | Edwards et al. | 118/669 |
| 7,287,821 | B2 * | 10/2007 | Uraki et al. | 347/14 |
| 7,445,306 | B2 * | 11/2008 | Hirota | 347/12 |
| 7,783,886 | B2 * | 8/2010 | Walmsley | 713/176 |
| 2002/0089559 | A1 * | 7/2002 | Drake | 347/15 |
| 2002/0101465 | A1 | 8/2002 | Maeda | |
| 2002/0118239 | A1 | 8/2002 | Du et al. | |
| 2004/0150693 | A1 | 8/2004 | Kojima et al. | |
| 2006/0055717 | A1 | 3/2006 | Hirota | |
| 2006/0139385 | A1 * | 6/2006 | Akiyama et al. | 347/9 |
| 2007/0285449 | A1 | 12/2007 | Ikemoto et al. | |
| 2010/0039469 | A1 | 2/2010 | Shimosato et al. | |
| 2010/0039472 | A1 * | 2/2010 | Ikemoto et al. | 347/15 |
| 2012/0069070 | A1 | 3/2012 | Shimosato | |

FOREIGN PATENT DOCUMENTS

| | | |
|---|---|---|
| JP | 03-221459 | 9/1991 |
| JP | 2012-045780 | 3/2012 |
| JP | 2013-043330 | 4/2013 |
| JP | 2013-059961 | 4/2013 |
| TW | 491772 | 6/2002 |
| WO | 2004-050369 | 6/2004 |

OTHER PUBLICATIONS

Office Action for Chinese Patent Application No. 201310376695.9 dated Dec. 2, 2014, 13 pages.

* cited by examiner

INK JET HEAD DRIVING DEVICE

CROSS-REFERENCE TO RELATED APPLICATION

This application is based upon and claims the benefit of priority from Japanese Patent Application No. 2012-186373, filed Aug. 27, 2012, the entire contents of which are incorporated herein by reference.

FIELD

Embodiments described herein relate generally to a driving device of an ink jet head used in an ink jet recording apparatus or the like.

BACKGROUND

In an inkjet head which includes a plurality of nozzles and forms a dot by ejecting ink from each nozzle, there is a demand for an amount of ink ejected from each nozzle to be uniform. However, there are cases where there is a disparity between amounts of ink ejected from a plurality of nozzles. In addition, there are cases where there is a disparity between an amount of ink ejected previously and an amount of ink ejected subsequently even from the same nozzle.

Although slight, if there is a disparity between amounts of ink ejected from the nozzles, density unevenness or color unevenness occurs in a part where a color is required to be uniform. In order to obtain a printing result in which unevenness is not viewed, each element of the nozzle related to dot formation is required to be considerably uniform. However, since very high processing accuracy is required for this, product costs increase.

DETAILED DESCRIPTION

In accordance with an embodiment, a driving device of an ink jet head including a plurality of ejection channels, includes a plurality of driving waveform generation portions that are provided so as to respectively correspond to the plurality of ejection channels, a random number generation portion that generates a pseudorandom number, and a connection portion. The respective driving waveform generation portions receive printing data and correction data, generate a driving signal of the ejection channels on the basis of the received printing data, correct a waveform of the driving signal by using the received correction data, and then output the corrected waveform to the corresponding ejection channels. The connection portion connects the random number generation portion to the respective driving waveform generation portions such that a pseudorandom number generated from the random number generation portion is supplied to each of the driving waveform generation portions as correction data having a value independent for each of the driving waveform generation portions.

Hereinafter, embodiments of an ink jet head driving device will be described with reference to the drawings. In addition, these embodiments employ an ink jet recording apparatus including a plurality of ink jet heads.

First Embodiment

About Ink Jet Head

First, an ink jet head used in this kind of ink jet recording apparatus will be described with reference to FIGS. 7 to 15.

Figure 7:
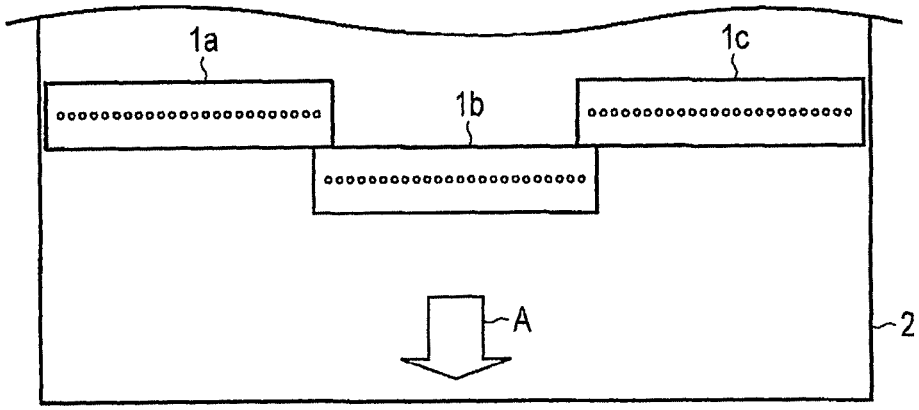
FIG. 7 is a schematic diagram illustrating an example of a head arrangement pattern of an ink jet recording apparatus which uses three ink jet heads.
Figure 8:
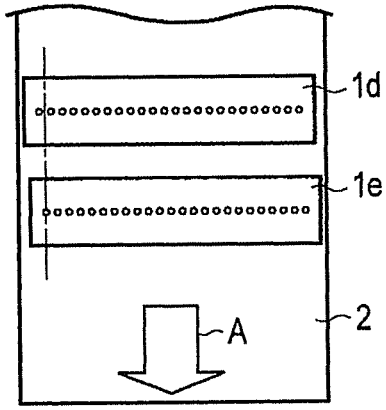
FIG. 8 is a schematic diagram illustrating an example of a head arrangement pattern of an ink jet recording apparatus which uses two ink jet heads.
Figure 9:
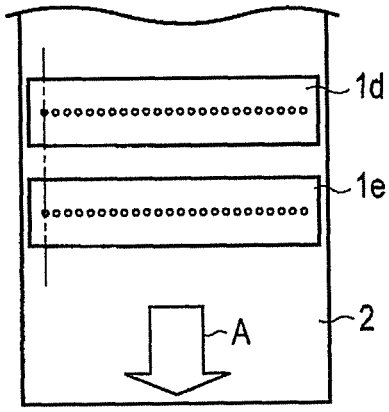
FIG. 9 is a schematic diagram illustrating another example of a head arrangement pattern of the ink jet recording apparatus which uses two ink jet heads.
Figure 10:
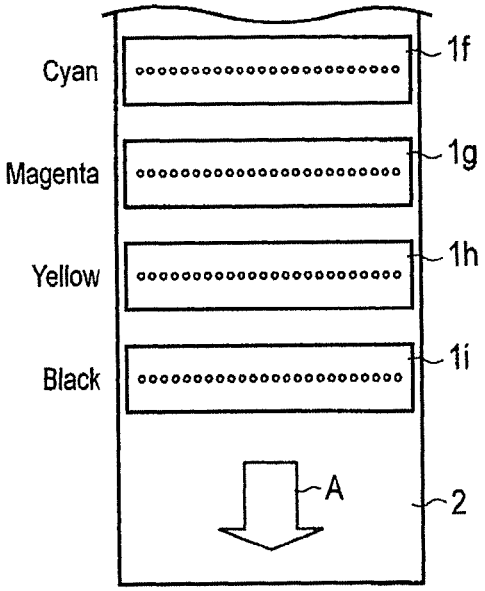
FIG. 10 is a schematic diagram illustrating an example of a head arrangement pattern of an ink jet recording apparatus which uses four ink jet heads.

FIGS. 7 to 10 show arrangement pattern examples of a plurality of ink jet heads 1 included in the inkjet recording apparatus, in which FIG. 7 shows an example of using three ink jet heads 1*a*, 1*b* and 1*c*, FIGS. 8 and 9 show an example of using two ink jet heads 1*d* and 1*e*, and FIG. 10 shows an example of four ink jet heads 1*f*, 1*g*, 1*h* and 1*i*. The respective ink jet heads 1*a* to 1*i* have the same length, number of nozzles and nozzle pitch as each other.

FIG. 7 shows an arrangement pattern example in which the length of each of the ink jet heads 1*a*, 1*b* and 1*c* is smaller than the width of a printing sheet 2. In this example, the three ink jet heads 1*a*, 1*b* and 1*c* in which an arrangement direction of the nozzles matches the sheet width direction perpendicular to the transport direction A of the printing sheet 2 are disposed so as to extend in the sheet width direction.

As shown in FIG. 7, the terminal end part (right end) of the first ink jet head 1*a* located on the left overlaps the front end part (left end) of the second ink jet head 1*b* located at the center. Similarly, the terminal end part of the second ink jet head 1*b* overlaps the front end part of the third ink jet head 1*c* located on the right. As above, the end parts of the respective ink jet heads 1*a*, 1*b* and 1*c* overlap each other such that an interval between the nozzle located on the terminal end side of one head and the nozzle located on the front end side of the other head matches the nozzle pitch of the inkjet heads 1*a*, 1*b* and 1*c*. This arrangement pattern is employed so as to perform line printing on the printing sheet 2 with the width larger than the length of each of the ink jet heads 1*a*, 1*b* and 1*c*.

FIGS. 8 and 9 show arrangement pattern examples in which the length of each of the ink jet heads 1*d* and 1*e* is approximately the same as the width of the printing sheet 2. In both of the examples shown in FIGS. 8 and 9, two ink jet heads 1*d* and 1*e* in which an arrangement direction of the nozzles matches the sheet width direction perpendicular to the transport direction A of the printing sheet 2 is disposed with a predetermined interval in the transport direction A.

In addition, in the example shown in FIG. 8, with respect to one ink jet head 1*d* located on the rear side in the transport direction A, the other ink jet head 1*e* located on the front side is shifted by a half length of the nozzle pitch in the nozzle arrangement direction. This arrangement pattern is employed so as to perform printing with the resolution twice as large as a resolution of each of the ink jet heads 1*d* and 1*e*.

In contrast, in the example shown in FIG. 9, positions of the respective nozzles of two ink jet heads 1*d* and 1*e* in the transport direction match each other. This arrangement pattern is employed so as to perform printing with the density twice as large as a density of each of the ink jet heads 1*d* and 1*e*. Alternatively, printing can be performed at twice the speed if a density is the same as a density of each of the ink jet heads 1*d* and 1*e*.

FIG. 10 shows an arrangement pattern example in which inks of different colors (cyan, magenta, yellow, and black) are ejected from four ink jet heads 1*f*, 1*g*, 1*h* and 1*i* each of which has approximately the same length as the width of the printing sheet 2, so as to perform color printing. In the example shown in FIG. 10, four ink jet heads 1*f*, 1*g*, 1*h* and 1*i* in which an arrangement direction of the nozzles matches in the sheet width direction perpendicular to the transport direction A of the printing sheet 2 are disposed with a predetermined interval in a direction perpendicular to the arrangement direction of the nozzles. The positions of the respective nozzles of the ink jet heads 1*f*, 1*g*, 1*h* and 1*i* match each other in the transport direction A. This arrangement pattern is employed such that dots of the respective colors of cyan, magenta, yellow and black are printed and mixed at the same location, thereby performing color printing.

Figure 11:
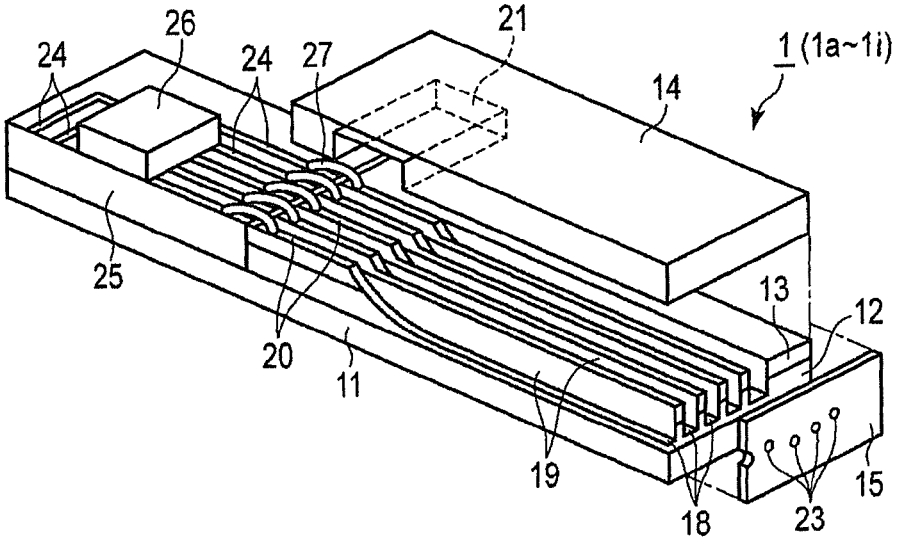
FIG. 11 is a partially exploded perspective view of the ink jet head.
Figure 12:
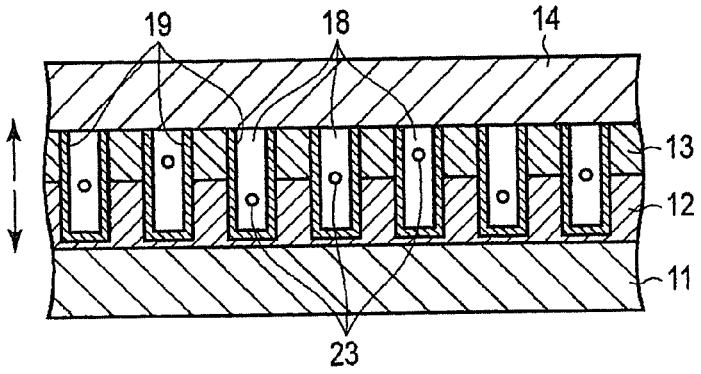
FIG. 12 is a transverse cross-sectional view in a front part.
Figure 13:
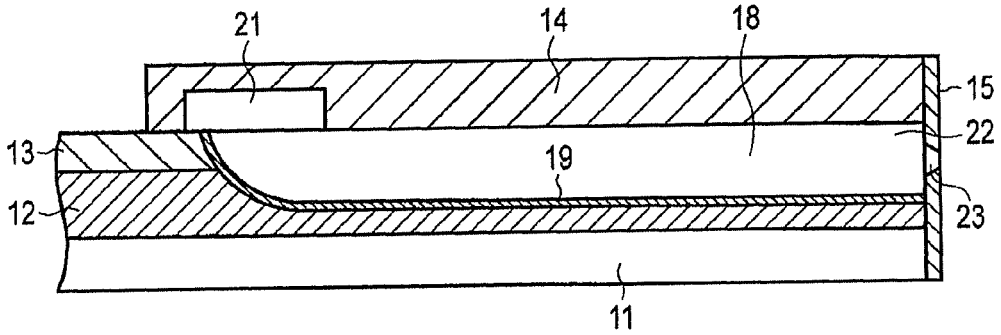
FIG. 13 is a longitudinal cross-sectional view in the front part.

FIGS. 11 to 13 are structure diagrams of main elements of a single ink jet head 1 (1*a* to 1*i*), in which FIG. 11 is a partially exploded view of the ink jet head 1, FIG. 12 is a transverse cross-sectional view in the front part of the ink jet head 1, and FIG. 13 is a longitudinal cross-sectional view in the front part of the ink jet head 1.

In the ink jet head 1, a first piezoelectric member 12 is bonded to an upper surface on a front side of a base substrate 11, and a second piezoelectric member 13 is bonded onto the first piezoelectric member 12. The first piezoelectric member 12 and the second piezoelectric member 13 are joined together so that each polarization to be opposed as indicated by the arrows of FIG. 12 in the plate thickness direction. The ink jet head 1 is provided with a plurality of long grooves 18 extending from the front end side of the joined piezoelectric members 12 and 13 to the rear end side. The respective grooves 18 have a constant interval and are parallel to each other. In addition, each groove 18 has an open front end and a rear end tilted upward.

In the ink jet head 1, an electrode 19 is provided on a partition and a bottom of each groove 18. Further, the ink jet head 1 is provided with an extraction electrode 20 which extends from the electrode 19 toward an upper surface of the rear part of the second piezoelectric member 13 from the rear end of each groove 18.

In the inkjet head 1, the upper parts of the respective grooves 18 are covered by a top plate 14, and the front ends of the respective grooves 18 are covered by an orifice plate 15. The top plate 14 includes a common ink chamber 21 on the inner rear side thereof.

In the inkjet head 1, a pressure chamber 22 which gives pressure to ink by each groove 18 surrounded by the top plate 14 and the orifice plate 15 on which nozzles 23 are opened. Each nozzle 23 forms eject ink.

In the ink jet head 1, a printed board 25 on which a conductive pattern 24 is formed is joined to the upper surface on the rear side of the base substrate 11, and a drive IC 26 including an ink jet head driving device 30 (refer to FIG. 1) described later is mounted on the printed board 25. The drive IC 26 is connected to the conductive pattern 24. The conductive pattern 24 is coupled to each extraction electrode 20 via a lead 27 in a wire bonding manner.

Figure 14A:
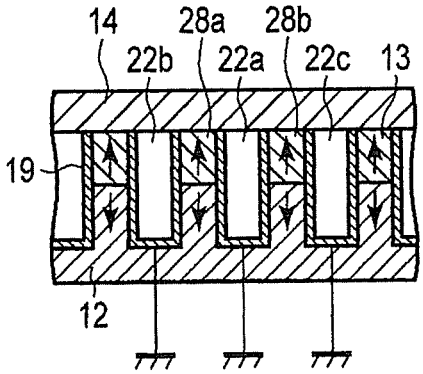
FIGS. 14A to 14C are schematic diagrams used to describe an operation principle of the ink jet head.
Figure 14B:
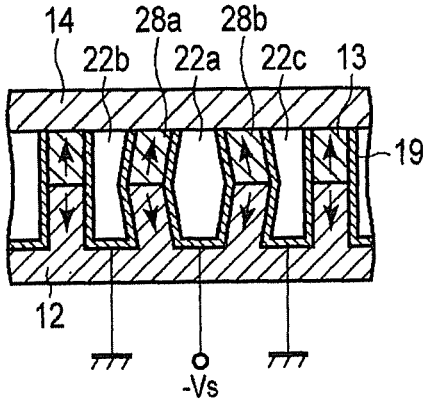
Figure 14C:
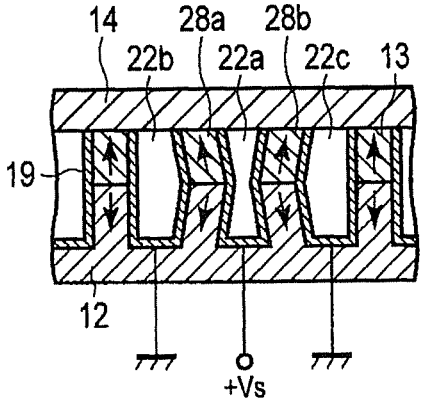
Figure 15:
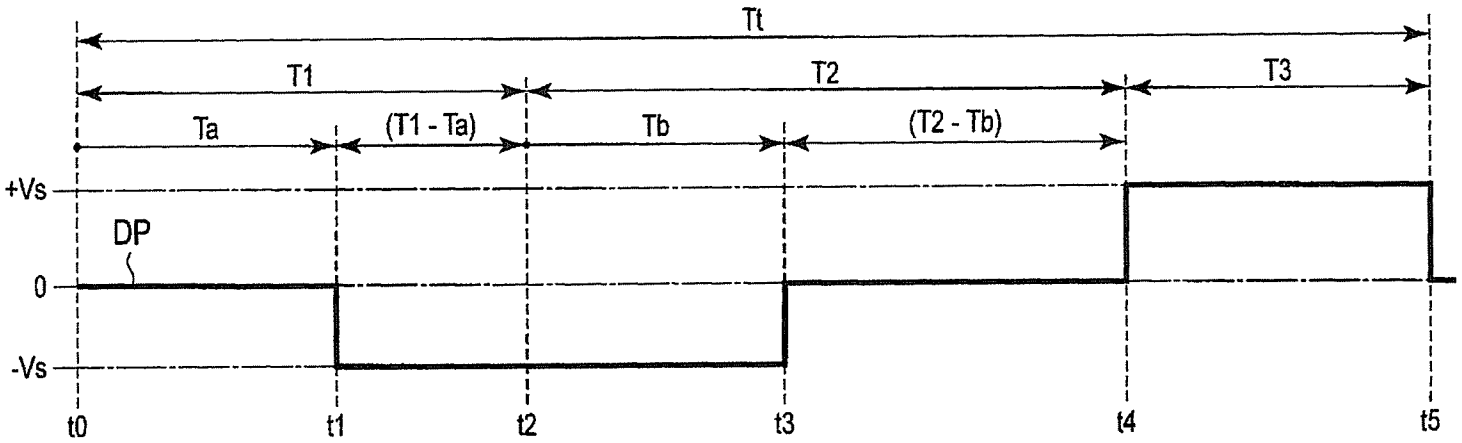
FIG. 15 is an application waveform diagram of a driving pulse signal which is applied to an ink ejection nozzle.

FIGS. 14A to 15 are diagrams illustrating an operation principle of the ink jet head 1.

FIG. 14A shows that the electrodes 19 of a central pressure chamber 22*a* and both pressure chamber 22*b* and 22*c* adjacent to the pressure chamber 22*a* are all in a ground potential state. In this state, partitions (actuators) 28*a* and 28*b*, which are formed by the piezoelectric members 12 and 13 interposed between the pressure chamber 22*a* and the pressure chamber 22*b* and between the pressure chamber 22*a* and the pressure chamber 22*c*, do not receive any distortion operation.

FIG. 14B shows a state in which a negative voltage (−Vs) is applied to the electrode 19 of the central pressure chamber 22*a*. In addition, the electrodes 19 of both the adjacent pressure chambers 22*b* and 22*c* have a ground potential. In this state, an electric field is applied to the respective partitions 28*a* and 28*b* in a direction perpendicular to a polarization direction of the piezoelectric members 12 and 13. Due to this application, the respective partitions 28*a* and 28*b* are deformed outward so as to increase a volume of the pressure chamber 22*a*.

FIG. 14C shows a state in which a positive voltage (+Vs) is applied to the electrode 19 of the central pressure chamber 22*a*. In addition, the electrodes 19 of both the adjacent pressure chambers 22*b* and 22*c* have a ground potential. In this state, an electric field is applied to the respective partitions 28*a* and 28*b* in an opposite direction to the case of FIG. 14B in the direction perpendicular to the polarization direction of the piezoelectric members 12 and 13. Due to this application, the respective partitions 28*a* and 28*b* are deformed inward so as to decrease a volume of the pressure chamber 22*a*.

FIG. 15 shows an application waveform of a driving pulse signal DP which is applied to the electrode 19 of the pressure chamber 22*a* in order to eject ink droplets from the central pressure chamber 22*a*. A section indicated by the time Tt is time required to eject an ink droplet (one droplet), and this time (referred to as one droplet cycle) Tt is divided into a preparation section time T1, an ejection section time T2, and a postprocessing section time T3. In addition, the preparation time T1 is subdivided into a normal section time Ta and an enlarged section time (T1-Ta), and the ejection section time T2 is subdivided into a maintaining section time Tb and a recovery section time (T2-Tb). The preparation time T1, the ejection time T2, and the postprocessing time T3 are set to appropriate values depending on conditions such as ink to be used or temperature.

As shown in FIG. 15, first, the ink jet head driving device 30 applies a voltage of 0 volts to the respective electrodes 19 corresponding to the pressure chambers 22*a*, 22*b* and 22*c* at the time point t0. In addition, the ink jet head driving device 30 waits the normal time Ta to elapse. During that time, the respective pressure chambers 22*a*, 22*b* and 22*c* are in the state shown in FIG. 14A.

When the normal time Ta elapses and then the time point t1 arrives, the ink jet head driving device 30 applies a predetermined negative voltage (−Vs) to the electrode 19 corresponding to the pressure chamber 22*a*. In addition, the inkjet head driving device 30 waits for the preparation time T1 to elapse. If the negative voltage (−Vs) is applied, the partitions 28*a* and 28*b* on both sides of the pressure chamber 22*a* are deformed outward so as to increase a volume of the pressure chamber 22*a*, and this leads to the state shown in FIG. 14B. The deformation reduces a pressure inside the pressure chamber 22*a*. For this reason, ink flows into the pressure chamber 22*a* from the common ink chamber 21.

When the preparation time T1 elapses and then the time point t2 arrives, the ink jet head driving device 30 continuously applies the negative voltage (−Vs) to the electrode 19 corresponding to the pressure chamber 22*a* until the holding time Tb further elapses. During that time, the respective pressure chambers 22*a*, 22*b* and 22*c* maintain the state shown in FIG. 14B.

When the maintaining time Tb elapses and then the time point t3 arrives, the ink jet head driving device 30 returns a voltage applied to the electrode 19 corresponding to the pressure chamber 22*a* to 0 volts. In addition, the ink jet head driving device 30 waits for the ejection time T2 to elapse. If an applied voltage is 0 volts, the partitions 28*a* and 28*b* on both sides of the pressure chamber 22*a* are recovered to a normal state, and this leads to the state shown in FIG. 14A again. The recovery increases a pressure inside the pressure chamber 22*a*. For this reason, ink droplets are ejected from the nozzle 23 corresponding to the pressure chamber 22*a*.

When the ejection time T2 elapses and then the time point t4 arrives, the ink jet head driving device 30 applies a predetermined positive voltage (+Vs) to the electrode 19 corresponding to the pressure chamber 22*a*. In addition, the ink jet head driving device 30 waits for the postprocessing time T3 to elapse. If the positive voltage (+Vs) is applied, the respective partitions 28*a* and 28*b* on both sides of the pressure chamber 22*a* are deformed inward so as to decrease a volume of the pressure chamber 22*a*, and this leads to the state shown in FIG. 14C. The deformation increases the pressure inside the pressure chamber 22*a*. This application of the pressure alleviates the pressure vibration after ejection of the ink droplets. When the postprocessing time T3 elapses and then the time point t5 arrives, the ink jet head driving device 30 returns a voltage applied to the electrode 19 corresponding to the pressure chamber 22*a* to 0 volts again. If the applied voltage returns to 0 volts, the partitions 28*a* and 28*b* on both sides of the pressure chamber 22*a* are recovered to a normal state. In other words, the respective pressure chamber 22*a*, 22*b* and 22*c* return to the state shown in FIG. 14A.

The ink jet head driving device 30 supplies the driving pulse signal DP with the application waveform shown in FIG. 15 to the electrode 19 of the central pressure chamber 22*a*. Therefore, one ink droplet is ejected from the nozzle 23 corresponding to the pressure chamber 22*a*.

About Overall Ink Jet Head Driving Device

Next, a configuration of the ink jet head driving device 30 will be described with reference to FIGS. 1 to 6.

Figure 1:
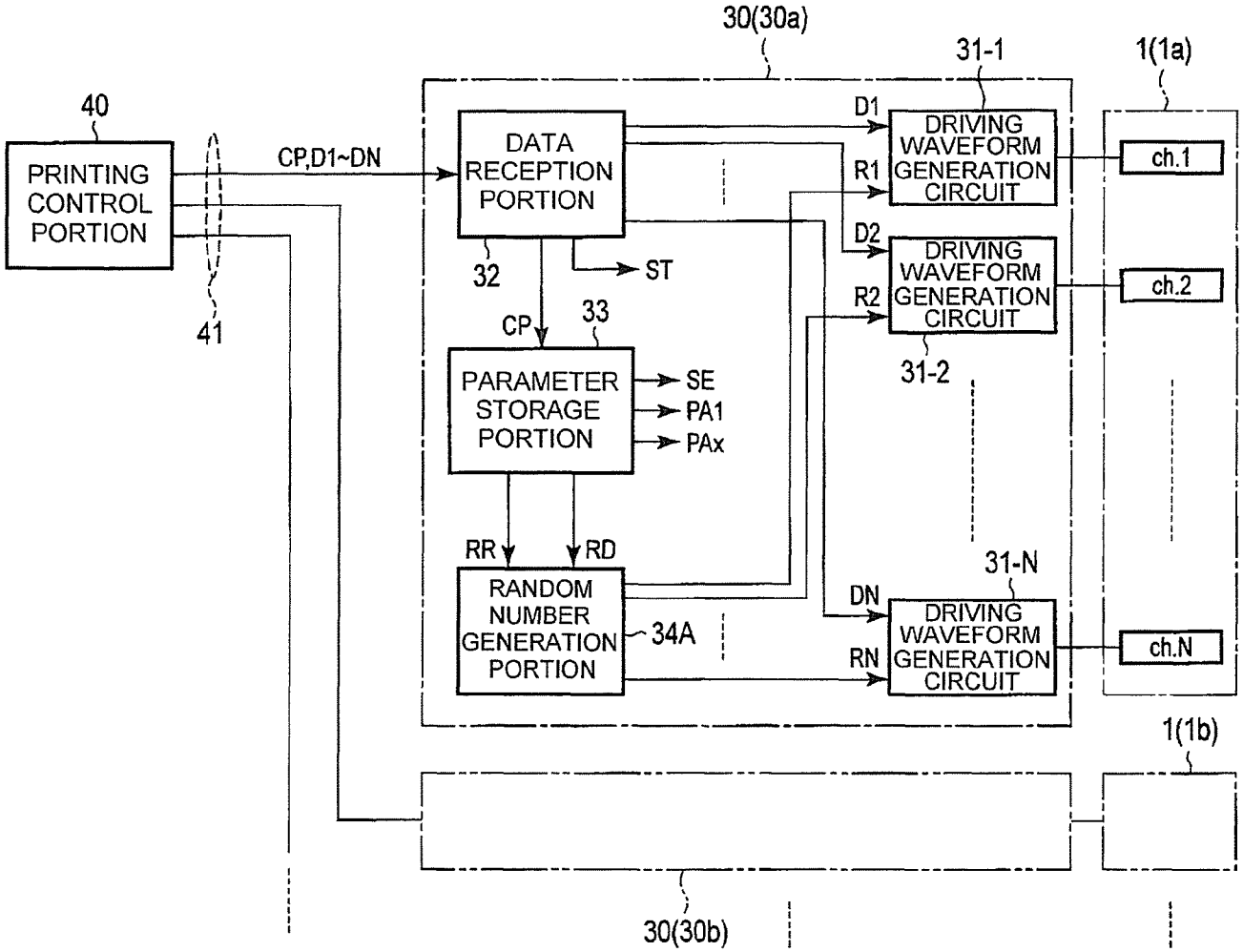
FIG. 1 is a block diagram illustrating a hardware configuration of an ink jet recording apparatus including an ink jet head driving device according to a first embodiment.

FIG. 1 is a block diagram illustrating a hardware configuration of an ink jet recording apparatus including the ink jet head driving device 30. The ink jet recording apparatus includes a plurality of ink jet heads 1 (1*a*, 1*b*, . . . ) structurally arranged like FIG. 7,8,9, or 10, a plurality of ink jet head driving devices 30 (30*a*, 30*b*, . . . ) provided so as to correspond to the respective ink jet heads 1 in a one-to-one relationship, and a printing control portion (print controller) 40 which collectively controls the ink jet head driving devices 30.

In the ink jet head 1, ch. 1, ch. 2, . . . , and ch. N indicate ejection channels. The ejection channels ch. 1, ch. 2, . . . , and ch. N correspond to the electrodes 20, electrodes 19, grooves 18, pressure chambers 22, and nozzles 23 included in the ink jet head 1 in a one-to-one relationship.

The printing control portion 40 which is structurally apart from ink jet head 1, is connected to the respective ink jet head driving devices 30 via signal lines 41 which is physically cable wires. The printing control portion 40 transmits printing data D1 to DN and a control parameter CP to the respective ink jet head driving devices 30 via the signal lines 41. The printing data D1 to DN and the control parameters CP may be transmitted through time division multiplexing into a single physical wire, or may be transmitted together using a plurality of physical wires.

The printing data D1 to DN is data indicating whether or not there is a dot from each of the ejection channels ch. 1 to ch. N, or representing greyscale density of each dot, and respectively corresponds to the ejection channels ch. 1 to ch. N of the ink jet head 1. In other words, the printing data D1 to DN is independent information for each of the ejection channels ch. 1 to ch. N, and has information of each dot in a direction along an arrangement direction (referred to as a spatial direction) of the respective ejection channels ch. 1 to ch. N and information of each dot in a direction along a direction (referred to as a temporal direction) perpendicular to the spatial direction.

The control parameters CP is set information required to perform printing, and, includes, for example, information regarding an application waveform of the driving pulse signal (basic driving waveform set value SE), a trigger (also called as a fire signal or an enable signal) for giving ink ejection timing (a start signal ST), or the like. In addition, the control parameters CP include various parameters P1 to Px required in an operation of the ink jet head 1 or random number initial value data RD described later. The control parameters CP are generally information common to a plurality of ejection channels ch. 1 to ch. N.

The ink jet head driving device 30 includes N driving waveform generation circuits 31-1 to 31-N which are provided so as to correspond to the respective ejection channels ch. 1 to ch. N of the corresponding ink jet head 1 in a one-to-one relationship, a data reception portion 32, a parameter storage portion 33, and a random number generation portion 34A.

The data reception portion 32 receives data transmitted from the printing control portion 40, and divides the data into printing data D1 to DN and control parameters CP so as to be processed. The printing data items D1 to DN are output to the driving waveform generation circuits 31-1 to 31-N of corresponding ejection channels in a parallel manner. The control parameters CP are output together to the parameter storage portion 33 except for the start signal ST. The start signal ST is output to the driving waveform generation circuits 31-1 to 31-N and the random number generation portion 34A.

About Driving Waveform Generation Circuit of Ink Jet Head Driving Device

Figure 2:
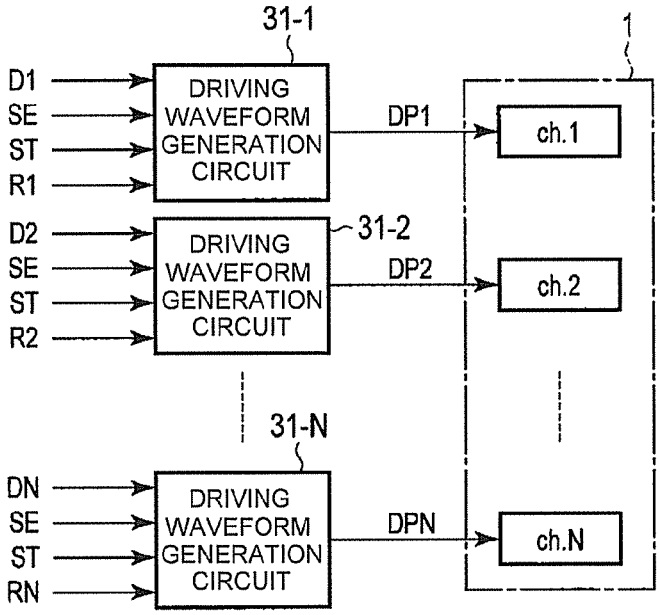
FIG. 2 is a diagram illustrating an example of a driving waveform generation circuit.

Each of the driving waveform generation circuits 31-1 to 31-N receives, as shown in FIG. 2, corresponding printing data D1 to DN, the basic driving waveform set value SE, the start signal ST, and corresponding correction data R1 to RN. The printing data D1 to DN and the start signal ST are given from the data reception portion 32. The basic driving waveform set value SE is given from the parameter storage portion 33. The correction data R1 to RN is given from the random number generation portion 34A.

The basic driving waveform set value SE is information for defining a variety of time (Ta, T1-Ta, Tb, T2-Tb, and T3) of driving pulse signals DP1 to DPN supplied to the corresponding ejection channels ch. 1 to ch. N from the driving waveform generation circuits 31-1 to 31-N. In addition, the basic driving waveform set value SE may include information for defining a deformation amount, deformation direction (inward or outward), or deformation speed of each of the partitions 28*a* and 28*b* which are actuators in the ejection channels ch. 1 to ch. N.

The printing data D1 to DN is information for defining how many times the driving pulse signals DP1 to DPN are continuously output to the corresponding ejection channels ch. 1 to ch. N from the respective driving waveform generation circuits 31-1 to 31-N. The number of outputs indicates the number of ink sub-droplets which are joined together so as to form a single dot. For this reason, the number of outputs of the driving pulse signals DP1 to DPN corresponds to a dot density. If the number of outputs is "0", a dot is not formed. In addition, if a single dot does not have a grayscale, the printing data D1 to DN may have only "1" and "0".

The correction data items R1 to RN are independent values for each of the driving waveform generation circuits 31, and are respectively given to the driving waveform generation circuits 31-1 to 31-N as correction values of ink filling time (T1-Ta) in the driving pulse signals DP1 to DPN. The ink filling time (T1-Ta) is corrected by the correction data R1 to RN so as to change a size of a sub-droplet.

The correction data items R1 to RN also can be independent values for temporal direction by updating R1 to RN synchronized with each of the start signal (ST) timing.

In addition, the amplitude of the driving pulse signals DP1 to DPN may be corrected instead of correction of the ink filling time (T1-Ta). A size of a sub-droplet is changed even by correcting the amplitude of the driving pulse signals DP1 to DPN.

The respective driving waveform generation circuits 31-1 to 31-N generate a basic driving waveform of the driving pulse signals DP1 to DPN on the basis of the basic driving waveform set value SE by using the start signal ST as a trigger. In addition, the respective driving waveform generation circuits 31-1 to 31-N change the basic driving waveform according to the printing data D1 to DN and the correction data R1 to RN so as to generate the driving pulse signals DP1 to DPN for the corresponding ejection channels ch. 1 to ch. N. The generated driving pulse signals DP1 to DPN are given to the electrodes 19 of the ejection channels ch. 1 to ch. N from the respective driving waveform generation circuits 31-1 to 31-N. Accordingly, the actuators corresponding to the respective ejection channels ch. 1 to ch. N are selectively operated, and ink droplets are ejected from any ejection channels ch. 1 to ch. N, thereby performing printing.

Figure 3:
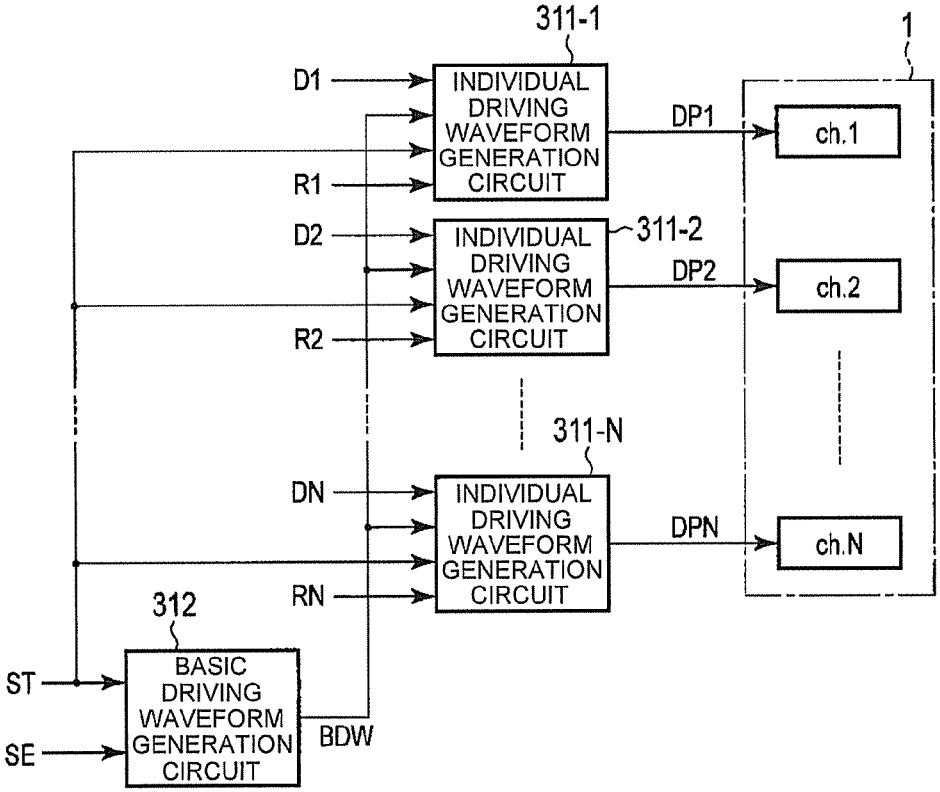
FIG. 3 is a diagram illustrating another example of the driving waveform generation circuit.

In FIG. 2, the respective driving waveform generation circuits 31-1 to 31-N are shown to be provided independently for each of the ejection channels ch. 1 to ch. N. But the circuit can be actually constructed as shown in FIG. 3, the respective driving waveform generation circuits 31-1 to 31-N may be divided into individual driving waveform generation circuits 311-1 to 311-N for the respective ejection channels ch. 1 to ch. N and a basic driving waveform generation circuit 312 common to the individual driving waveform generation circuits 311-1 to 311-N.

The basic driving waveform generation circuit 312 receives the start signal ST and the basic driving waveform set value SE. If the start signal ST is input, the basic driving waveform generation circuit 312 generates a basic driving waveform of the driving pulse signals DP1 to DPN on the basis of the basic driving waveform set value SE. In addition, the basic driving waveform generation circuit 312 outputs a signal of the basic driving waveform to the respective individual driving waveform generation circuits 311-1 to 311-N as a basic driving waveform signal BDW.

The individual driving waveform generation circuits 311-1 to 311-N receive the start signal ST, the printing data D1 to DN, and the correction data R1 to RN in addition to the basic driving waveform signal BDW. When the start signal ST is input, the respective individual driving waveform generation circuits 311-1 to 311-N change a waveform of the basic driving waveform signal BDW according to the printing data D1 to DN and the correction data R1 to RN so as to generate the driving pulse signals DP1 to DPN for the corresponding ejection channels ch. 1 to ch. N. The generated driving pulse signals DP1 to DPN are given to the electrodes 19 of the corresponding ejection channels ch. 1 to ch. N from the individual driving waveform generation circuits 311-1 to 311-N.

The basic driving waveform generation circuit 312 is required to be synchronized with the individual driving waveform generation circuits 311-1 to 311-N. For this reason, in the configuration shown in FIG. 3, the start signal ST is input to both of the basic driving waveform generation circuit 312 and the individual driving waveform generation circuits 311-1 to 311-N.

In the configuration shown in FIG. 3, each of the individual driving waveform generation circuits 311-1 to 311-N is not required to have a copy of the basic driving waveform generation circuit 312. In other words, in the configuration shown in FIG. 3, the number of the basic driving waveform generation circuits 312 is reduced, and thus a circuit scale can be saved. This effect becomes notable as the number of channels of the ink jet head 1 increases.

About Random Number Generation Portion of Ink Jet Head Driving Device.

Figure 4:
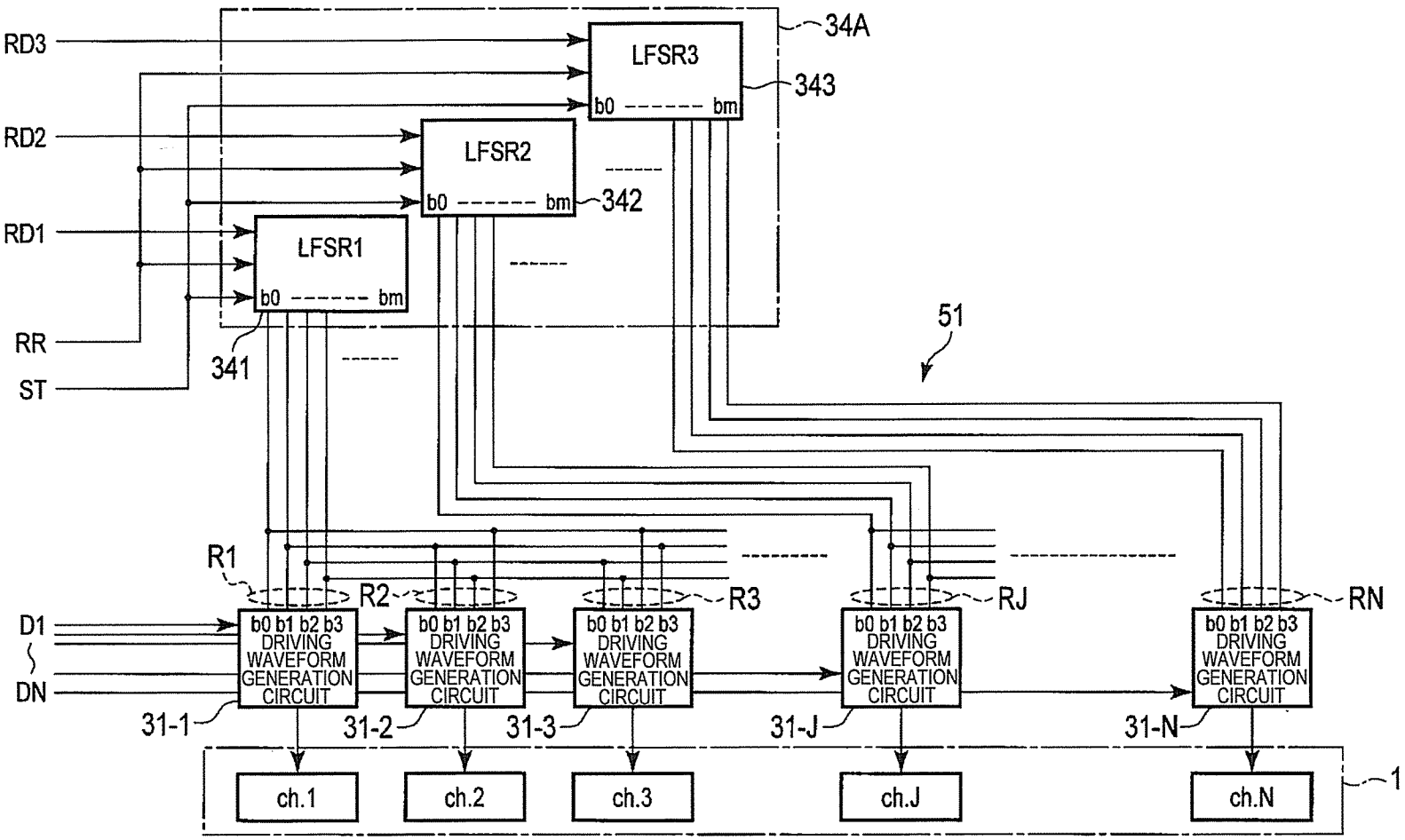
FIG. 4 is a diagram illustrating an example of a random number generation portion.

The random number generation portion 34A generates a pseudorandom number which is formed by a plurality of bits which are smaller than a total number of bits of correction data to be input to the respective driving waveform generation circuits 31-1 to 31-N. In other words, the random number generation portion 34A is formed by a plurality of (in FIG. 4, three) independent linear feedback shift registers (LFSRs) 341, 342 and 343 as shown in FIG. 4. The linear feedback shift registers 341, 342 and 343 are a kind of random number generation circuit, receive in common a start signal ST and a random initialization signal PR, and receive initial value data RD1, RD2 and RD3, respectively. The start signal ST is given from the data reception portion 32. The random initialization signal PR and the initial value data RD1, RD2 and RD3 are given from the parameter storage portion 33. The respective linear feedback shift registers 341, 342 and 343 generate a "m+1"-bit pseudo-random number called an M-sequence pulse on the basis of the start signal ST, the random number initialization signal PR, and the initial value data RD1, RD2 and RD3.

The linear feedback shift registers 341, 342 and 343 of the random number generation portion 34A are connected to the driving waveform generation circuits 31-1 to 31-N via wires 51 which are a connection portion. The wires 51 connects the random number generation portion 34A to the driving waveform generation circuits 31-1 to 31-N so as to give respective bits b0 to bm of a pseudo-random number generated from each of the linear feedback shift registers 341, 342 and 343 to the driving waveform generation circuits 31-1 to 31-N as the correction data R1 to RN. In this case, the wires 51 are connected such that each of the correction data R1 to RN is assigned to the driving waveform generation circuits 31-1 to 31-N in the logic in which "the same output bit of a pseudo-random number does not overlap bits having the same weight of correction data to be input" i.e. each pseudorandom bit from the LFSRs should not be connected to the same weighted bit of different waveform generators simultaneously.

In FIG. 4, the correction data R1 to RN formed by four bits including b0, b1, b2 and b3 is input to the respective driving waveform generation circuits 31-1 to 31-N. If the correction data R1 to RN is formed by four bits, each of the driving waveform generation circuits 31-1 to 31-N can correct a size of a sub-droplet in sixteen levels including no change. Here, any one of pseudo-random number output bits b0 to bm of each of the linear feedback shift registers 341, 342 and 343 can be assigned to the bit b0 (or b1, b2, b3) of correction data in any one of the driving waveform generation circuits 31-1 to 31-N. The pseudo-random number output bit can be connected to another weighted bit of correction data in another driving waveform generation circuits, but never connected to the same weighted bit of correction data in another driving waveform generation circuit simultaneously.

For example, in FIG. 4, the pseudo-random number output bit b0 of the first linear feedback shift register 341 is assigned to the bit b0 of correction data in the driving waveform generation circuit 31-1 corresponding to the ejection channel ch. 1. This pseudo-random number output bit b0 is also assigned to the bit b3 of correction data in the driving waveform generation circuit 31-2 corresponding to the ejection channel ch. 2 and the bit b2 of correction data in the driving waveform generation circuit 31-3 corresponding to the ejection channel ch. 3. However, this pseudo-random number output bit b0 is never assigned to the bit b0 of correction data in the driving waveform generation circuits 31-2 to 31-N other than the driving waveform generation circuit 31-1. This is also the same for other bits b1, b2 and b3.

As above, the correction data R1 to RN are given to the respective driving waveform generation circuits 31-1 to 31-N such that the same output bit of a pseudo-random number does not overlap bits having the same weight of correction data to be input, and thus the respective driving waveform generation circuits 31-1 to 31-N perform random correction on the driving pulse signals DP1 to DPN. As a result, there is no regularity in a correction amount among the respective ejection channels ch. 1 to ch. N, i.e. the correction amount is random. In addition, a value of a pseudo-random number generated by each of the linear feedback shift registers 341, 342 and 343 is updated each time the start signal ST is input. Accordingly, a correction amount of each dot is also random in the temporal direction.

Figure 5:
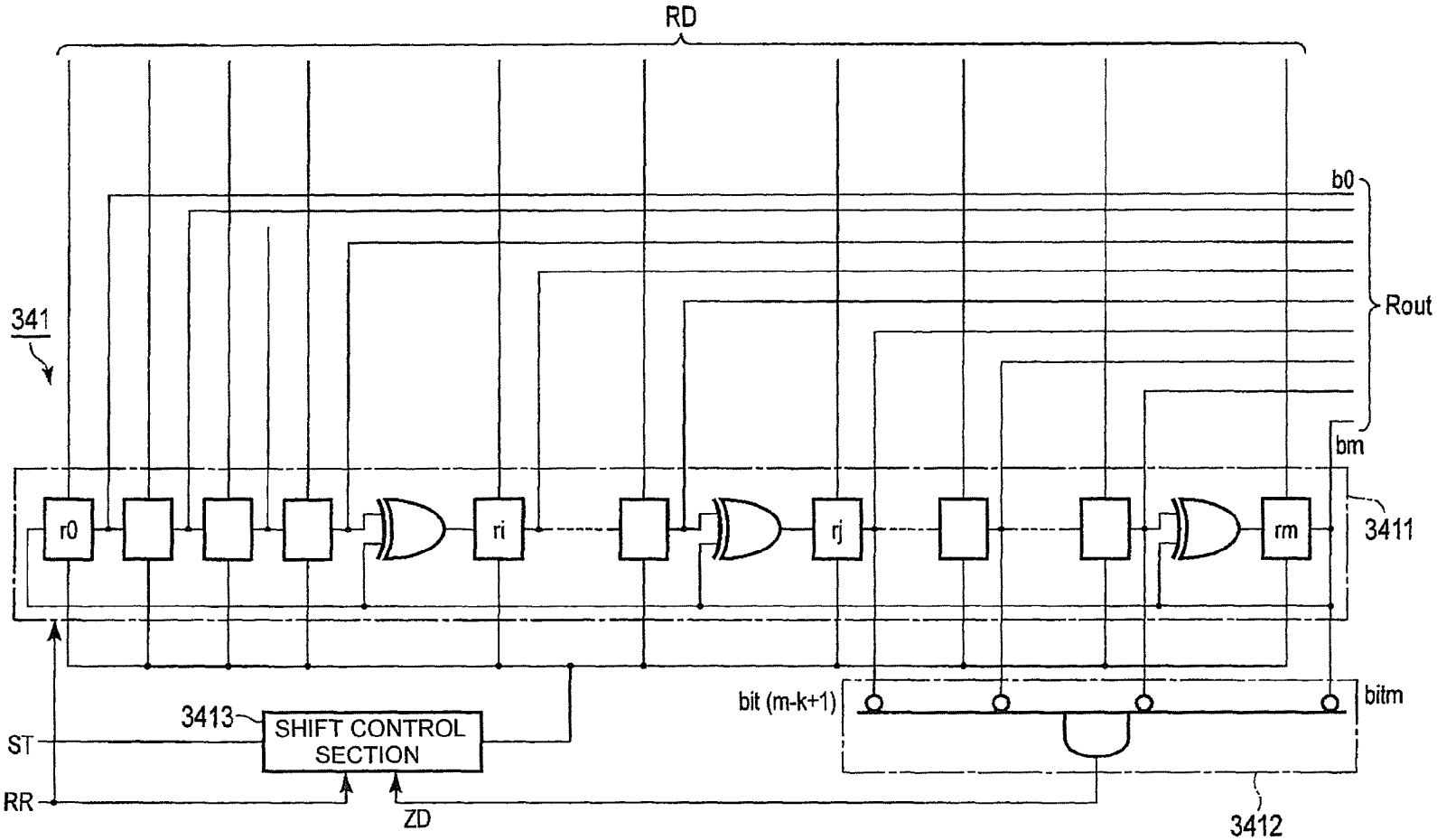
FIG. 5 is a circuit configuration diagram of a linear feedback shift register.

FIG. 5 is a circuit configuration diagram of the linear feedback shift register 341. The other linear feedback shift registers 342 and 343 have the same configuration as the linear feedback shift register 341, and description thereof will be omitted here.

The linear feedback shift register 341 includes a shift register section 3411, a zero detection section 3412, and a shift control section 3413. The shift register section 3411 is formed by "m+1"-stage shift registers from "0" to "m" (where m>0), and an output bm of a register rm of the "m+1"-th stage is fed back to a register r0 of the first stage. In addition, the output bm of the register rm of the "m+1"-th stage is fed back to registers ri and rj other than the register of the first stage by taking exclusive OR. An output Rout (b0 to bm) of the shift register section 3411 can be set as a pseudo-random number called an M sequence which scarcely has regularity depending on which stage is a destination fed back by taking the exclusive OR. The linear feedback shift register 341 can be a Fibonacci LFSR, a Galois LFSR, a maximum-length LFSR, and the like.

The start signal ST is given to the shift control section 3413 of the linear feedback shift register 341. The shift control section 3413 shifts the shift register section 3411 by one bit each time the start signal ST is input. This shift updates an output Rout of the shift register section 3411.

The random number initialization signal RR is given to the shift control section 3413 and the shift register section 3411. The random number initial value data RD is given to the registers r0 to rm of the respective stages of the shift register section 3411, and the shift register section 3411 writes the initial value data RD in the registers r0 to rm of the respective registers. The shift control section 3413 is reset when the random number initialization signal RR is input thereto.

The zero detection section 3412 monitors bits b(m−k+1) to bm output from higher-rank k (where 0<k<m) registers of the shift register section 3411, and outputs a zero detection signal ZD to the shift control section 3413 if zeros are arranged in higher k bits. The shift control section 3413 controls the shift register section 3411 so as to be shifted by the k bits or more between successive start signal ST if the zero detection signal ZD is input thereto.

Generally, in the linear feedback shift register, if zeros are arranged in higher bits, a pseudo-random number is sluggish because the exclusive OR should not be true. In the present embodiment, if zeros are arranged in higher k bits, shift of the shift register section 3411 progresses by k or more bits through an operation of the zero detection section 3412 and the shift control section 3413. Thus the random number is maintained not to be sluggish.

Initial value data items RD1, RD2 and RD3 which are respectively given to the linear feedback shift registers 341, 342 and 343 are values selected in advance as different from each other and zero, for the purpose of removing regularity between random numbers generated by the linear feedback shift registers 342, 342 and 343. In addition, the initial value data RD1, RD2 and RD3 is incorporated into the control parameters CP from the printing control portion 40, and is sent to the ink jet head driving device 30 so as to be stored in the parameter storage portion 33.

About Parameter Storage Portion of Ink Jet Head Driving Device

Figure 6:
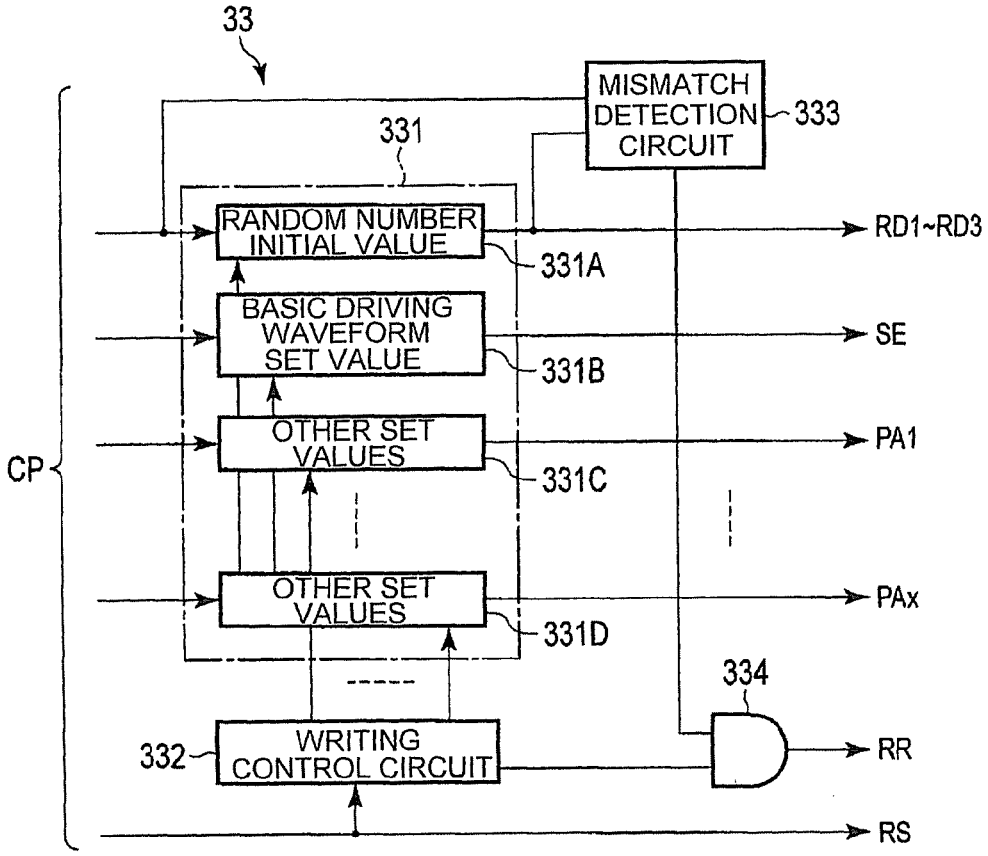
FIG. 6 is a configuration diagram of main elements of a parameter storage portion included in the ink jet head driving device.

FIG. 6 is a configuration diagram of main elements of the parameter storage portion 33, and the parameter storage portion 33 includes a memory section 331, a writing control circuit 332, a mismatch detection circuit 333, and an AND gate 334. The memory section 331 includes an area 331A which stores the random number initial value data RD (RD1 to RD3), an area 331B which stores the basic driving waveform set value SE, and areas 3310 and 331D which store other parameters PA1 to PAx required in an operation of the ink jet head 1. These values are included in the control parameters CP.

The memory section 331 is reset using hardware reset (not shown) when the device starts to power up. Each of the areas 331A to 331D is cleared due to this reset.

The writing control circuit 332 controls data recording to each of the areas 331A to 331D of the memory section 331 under control of the control parameter CP. In other words, the writing control circuit 332 controls recording of the random number initial value data RD1 to RD3 included in the control parameters CP in relation to the area 331A, and controls recording of the basic driving waveform set value SE included in the control parameters CP in relation to the area 331B. In addition, when the initialization signal RS is input, the writing control circuit 332 outputs the signal to one input terminal of the AND gate 334. The initialization signal RS is also given to the driving waveform generation circuits 31-1 to 31-N so as to reset the driving waveform generation circuits 31-1 to 31-N.

The mismatch detection circuit 333 compares the previous time random number initial value data RD stored in the area 331A with this time random number initial value data RD which is written in the area 331A under the control of the writing control circuit 332. In addition, if mismatch between both of the random number initial value data items RD is detected, an application signal with a predetermined pulse duration is output to the other input terminal of the AND gate 334.

Then the AND gate 334 sends the random number initialization pulse signal RR, which is supplied to one input terminal from the writing control circuit 332, to the random number generation portion 34A during the supply of the application signal to the other input terminal from the mismatch detection circuit 333. The random number generation portion 34A is initialized when receiving the random number initialization signal RR.

Typically, the control parameters CP are sent to each ink jet head driving device 30 from the printing control portion 40 along with the printing data D1 to DN. If the random number generation portion 34A is initialized each time the control parameters CP are input, correction data R1 to RN with the same pattern is generated from the random number generation portion 34A each time the control parameters CP are updated. In other words, the correction data R1 to RN has regularity.

In order to remove this regularity, in the present embodiment, in relation to the random number initialization signal RR, the random number initialization signal RR is output so as to initialize the random number generation portion 34A only if a previous time value and this time value of the random number initial value data RD are different from each other. In other words, since the random number generation portion 34A is not initialized while the random number initial value data RD is not changed, the correction data R1 to RN has no regularity.

About Conclusion of Present Embodiment

In the ink jet head driving device 30 of the present embodiment, the correction data R1 to RN, which is random not only in an arrangement direction (spatial direction) of the ejection channels ch. 1 to ch. N of the ink jet head 1 but also in a direction (temporal direction) perpendicular to the spatial direction, is given to the respective driving waveform generation circuits 31-1 to 31-N from the random number generation portion 34A. By the use of the correction data R1 to RN, for example, the ink filling time (T1-Ta) of the driving pulse signals DP1 to DPN is randomly corrected in the respective driving waveform generation circuits 31-1 to 31-N. As a result, an amount of ink droplets, which are ejected from nozzles corresponding to the respective channels ch. 1 to ch. N of the ink jet head 1 driven by the corrected driving pulse signals DP1 to DPN, causes a minute change which is random in both the spatial direction and the temporal direction. In other words, a small change occurs in a printing density.

Generally, a human visual sense tends to perceive density unevenness with regularity. Density errors caused by a disparity between nozzles or actuators occurring in manufacturing an ink jet head or density errors occurring depending on a printing pattern such as crosstalk have regularity spatially and temporally. For this reason, printing unevenness tends to be visible.

However, the ink jet head driving device 30 of the present embodiment can give a random small change to a printing density. This random minute change in a printing density has no regularity and is thus hardly visible. Therefore, according to the present embodiment, even if there are density errors caused by a disparity between nozzles or actuators of the ink jet head 1 or density errors occurring depending on a printing pattern such as crosstalk, printing unevenness can be made to be invisible.

Second Embodiment

Figure 16:
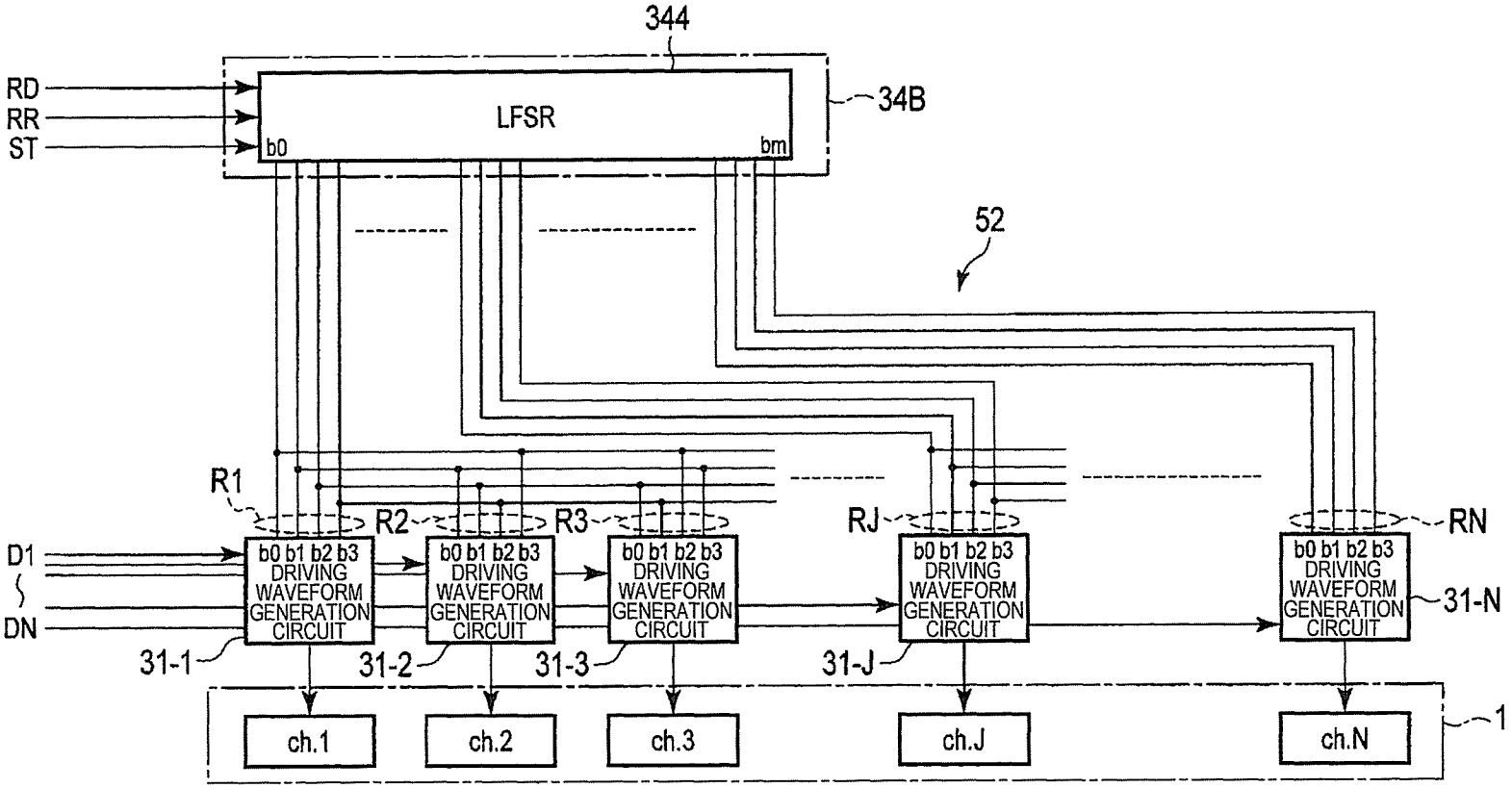
FIG. 16 is a configuration diagram of main elements according to a second embodiment.

In the above-described first embodiment, the random number generation portion 34A is formed by a plurality of linear feedback shift registers 341, 342 and 343, and generates a pseudo-random number formed by a plurality of bits smaller than a total number of bits of correction data to be input to the respective driving waveform generation circuits 31-1 to 31-N. In addition, the respective bits b0 to bm of a pseudo-random number generated from each of the linear feedback shift registers 341, 342 and 343 is assigned to the driving waveform generation circuits 31-1 to 31-N in the logic in which "the same output bit of a pseudo-random number does not overlap bits having the same weight of correction data to be input". For this reason, the number of minimum required linear feedback shift registers is calculated from a total number of correction data to be input to the respective driving waveform generation circuits 31-1 to 31-N and a bit length of a pseudo-random number generated from a single linear feedback shift register, so as to form the random number generation portion 34A. In the first embodiment, the number of linear feedback shift registers is three. The number of linear feedback shift registers is not limited to three. FIG. 16 is a diagram illustrating an example in which a random number generation portion 34B is formed by a single linear feedback shift register and shows a second embodiment. In addition, an element common to FIG. 4 described in the first embodiment is given the same reference numeral, and detailed description thereof will be omitted.

As shown in FIG. 16, in the second embodiment, the random number generation portion 34B is formed by a single linear feedback shift register 344. The linear feedback shift register 344 receives a start signal ST, a random number initialization signal RR, and initial value data RD. The start signal ST is given from the data reception portion 32. The random number initialization signal RR and the initial value data RD are given from the parameter storage portion 33. The linear feedback shift register 344 generates a "m+1"-bit pseudo-random number called an M-sequence pulse on the basis of the start signal ST, the random number initialization signal RR, and the initial value data RD.

Respective bits b0 to bm of a pseudo-random number generated from the linear feedback shift register 344 are given to the driving waveform generation circuits 31-1 to 31-N via wires 52 which is a connection portion as correction data R1 to RN. Each of the correction data R1 to RN is assigned to the driving waveform generation circuits 31-1 to 31-N with random manner, i.e. the assignment between them is predetermined with random basis.

According to the second embodiment, the number of linear feedback shift registers 344 forming the random number generation portion 34B can be saved to one, and similar effect as in the first embodiment can be achieved.

Third Embodiment

In the second embodiment, the random number generation portion 34B is formed by a single linear feedback shift register 344. A random number generation portion is not limited to the configuration of the above-described first or second embodiment.

Figure 17:
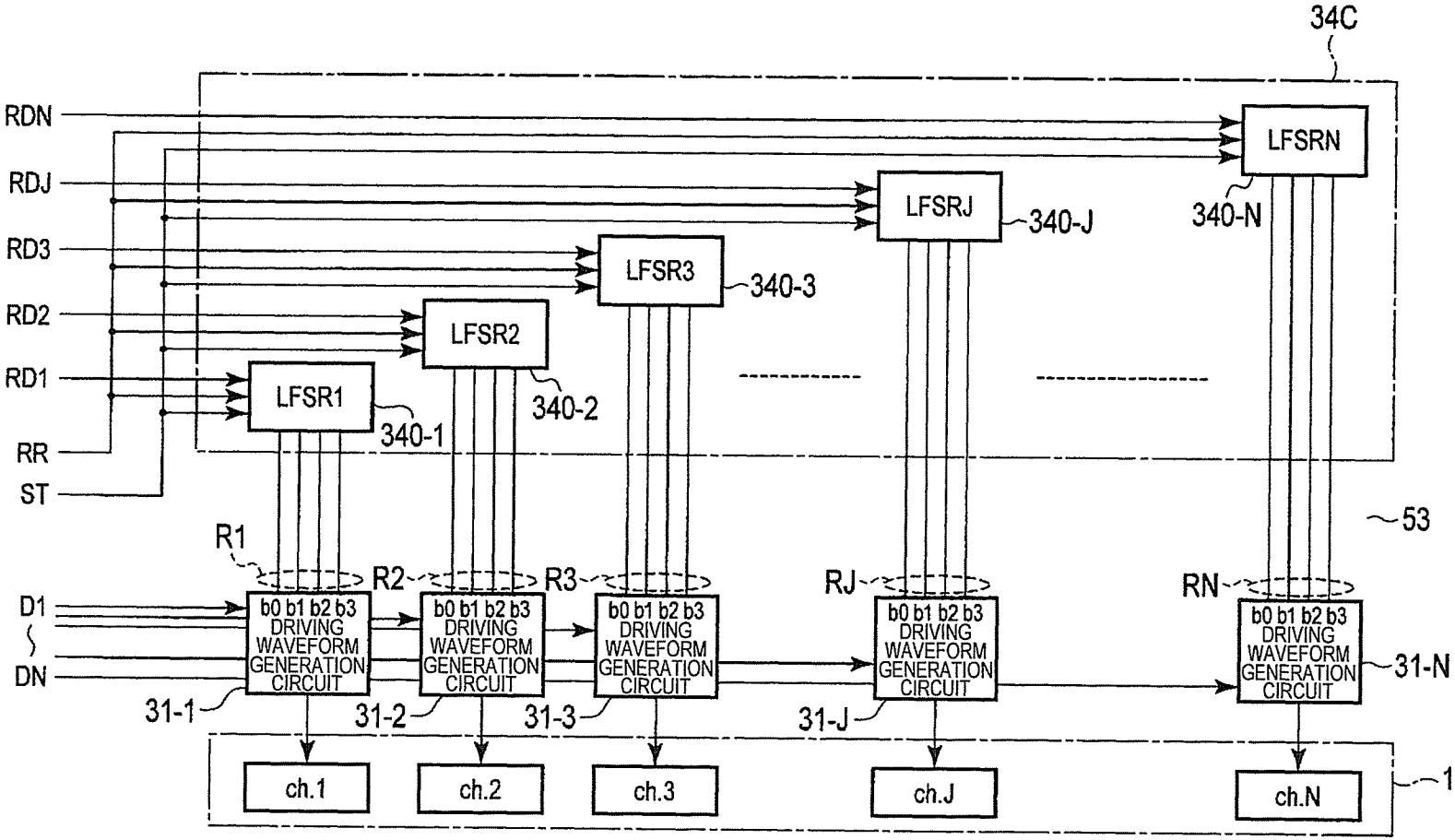
FIG. 17 is a configuration diagram of main elements according to a third embodiment.

FIG. 17 shows a random number generation portion 34C having another configuration, and shows a third embodiment. In addition, an element common to FIG. 4 is given the same reference numeral, and detailed description thereof will be omitted.

As shown in FIG. 17, the random number generation portion 34C is formed by N linear feedback shift registers 340-1 to 340-N having the same number as the number of ejection channels ch. 1 to ch. N of the ink jet head 1. The linear feedback shift registers 340-1 to 340-N respectively correspond to the driving waveform generation circuits 31-1 to 31-N which are provided so as to correspond to the ejection channels ch. 1 to ch. N, in a one-to-one relationship.

The linear feedback shift registers 340-1 to 340-N receive in common a start signal ST and a random number initialization signal RR, and receive initial value data RD1, RD2, RD3, . . . , RDJ, . . . , and RDN, respectively. The start signal ST is given from the data reception portion 32. The random number initialization signal RR and the initial value data RD1, RD2, RD3, . . . , RDJ, . . . , and RDN are given from the parameter storage portion 33. The respective linear feedback shift registers 340-1 to 340-N generate a 4 bit pseudo-random number on the basis of the start signal ST, the random number initialization signal RR, and the initial value data RD1, RD2, RD3, . . . , RDJ, . . . , and RDN.

Among bits b0 to bm of a pseudo-random number generated from each of the linear feedback shift registers 340-1 to 340-N, for example, the bits b0 to b3 are given to the corresponding driving waveform generation circuits 31-1 to 31-N via wires 53 which is a connection portion as correction data R1 to RN.

According to the third embodiment, similar effect as in the first embodiment can be achieved assigning the respective bits b0 to bm of a pseudo-random number generated from each of the linear feedback shift registers 340-1 to 340-N to the driving waveform generation circuits 31-1 to 31-N independently.

Fourth Embodiment

In the above-described first to third embodiments, since the driving waveform generation circuits 31-1 to 31-N correspond to the ejection channels ch. 1 to ch. N of the ink jet head 1 in a one-to-one relationship, each of the ejection channels ch. 1 to ch. N can be driven individually and independently. However, in the ink jet head 1, a plurality of ejection channels may be divided into a plurality of groups, and may be driven together for each group.

Therefore, next, an embodiment in which a plurality of ejection channels are divided into two groups and are driven together for each group will be described as a fourth embodiment.

Figure 18:
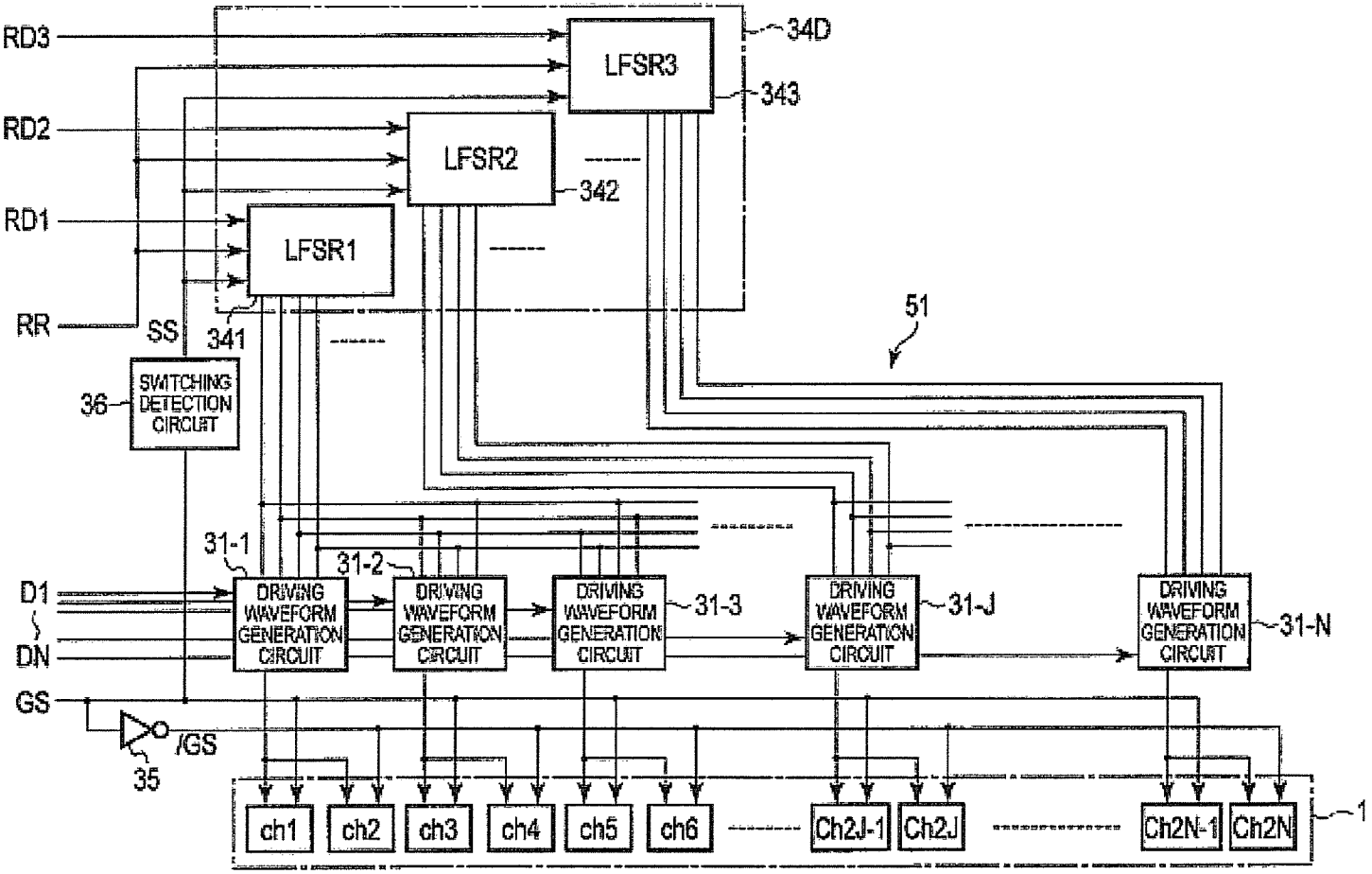
FIG. 18 is a configuration diagram of main elements according to a fourth embodiment.

FIG. 18 is a configuration diagram of main elements according to the fourth embodiment, and an element common to FIG. 4 is given the same reference numeral, and detailed description thereof will be omitted.

As shown in FIG. 18, the ejection channels ch. 1 to ch. 2N of the ink jet head 1 are divided into a first group and a second group every other one in an arrangement direction thereof. In other words, the ejection channels ch. 1, ch. 3, ch. 5, . . . , ch. 2J-1, . . . , and ch. 2N-1 are included in the first group, and the ejection channels ch. 2, ch. 4, ch. 6, ch. 2J, . . . , and ch. 2N are included in the second group.

The driving waveform generation circuits 31-1 to 31-N are provided so as to respectively correspond to the ejection channels ch. 1, ch. 3, ch. 5, . . . , ch. 2J-1, . . . , and ch. 2N-1 included in the first group. In addition, driving pulse signals DP1 to DPN output from the respective driving waveform generation circuits 31-1 to 31-N are supplied in common to the corresponding ejection channels ch. 1, ch. 3, ch. 5, . . . , ch. 2J-1, . . . , and ch. 2N-1 of the first group and the ejection channels ch. 2, ch. 4, ch. 6, ch. 2J, . . . , and ch. 2N of the second group adjacent to the ejection channels ch. 1, ch. 3, ch. 5, . . . , ch. 2J-1, . . . , and ch. 2N-1 in one direction.

Among the ejection channels ch. 1 to ch. 2N, a group selection signal GS is supplied to the ejection channels ch. 1, ch. 3, ch. 5, . . . , ch. 2J-1, . . . , and ch. 2N-1 included in the first group. An inverted group selection signal /GS which is inverted by an inverter 35 is supplied to the ejection channels ch. 2, ch. 4, ch. 6, ch. 2J-1, . . . , and ch. 2N included in the second group. The group selection signal GS is included in the control parameters CP, and is given to the ink jet head 1 via the data reception portion 32.

The respective ejection channels ch. 1, ch. 3, ch. 5, . . . , ch. 2N-1 or ch. 2, ch. 4, ch. 6, . . . , ch. 2N receive the driving pulse signals DP1 to DPN while the group selection signal GS or the inverted group selection signal /GS is input thereto, and eject ink droplets in response to the driving pulse signals DP1 to DPN. In other words, the ejection channels ch. 1, ch. 3, ch. 5, . . . , ch. 2J-1, . . . , and ch. 2N-1 included in the first group are driven together, and the ejection channels ch. 2, ch. 4, ch. 6, ch. 2J, . . . , and ch. 2N included in the second group are not driven during that time. Conversely, the ejection channels ch. 2, ch. 4, ch. 6, ch. 2J, . . . , and ch. 2N included in the second group are driven together, and the ejection channels ch. 1, ch. 3, ch. 5, . . . , ch. 2J-1, . . . , and ch. 2N-1 included in the first group are not driven during that time.

The random number generation portion 34D is formed by a plurality of (in FIG. 18, three) independent linear feedback shift registers 341, 342 and 343 in the same manner as in the first embodiment. The linear feedback shift registers 341, 342 and 343 receive in common a switching detection signal SS and a random number initialization signal RR, and receive initial value data RD1, RD2 and RD3, respectively.

The random number initialization signal RR and the initial value data RD1, RD2 and RD3 are given from the parameter storage portion 33. The switching detection signal SS is given from a switching detection circuit 36. The switching detection circuit 36 receives the group selection signal GS and outputs the switching detection signal SS each time the group selection signal GS is changed.

When the switching detection signal SS is input, the respective linear feedback shift registers 341, 342 and 343 generate a "m+1"-bit pseudo-random number called an M-sequence pulse on the basis of the random number initialization signal RR, and the initial value data RD1, RD2 and RD3. In other words, a value of a pseudo-random number generated by each of the linear feedback shift registers 341, 342 and 343 is updated each time the switching detection signal SS is input thereto (random number updating portion). Therefore, a value of a pseudo-random number is updated each time the ejection channels ch. 1, ch. 3, ch. 5, . . . , ch. 2N-1 or ch. 2, ch. 4, ch. 6, . . . , ch. 2N are driven for each group.

Respective bits b0 to bm of a pseudo-random number generated from each of the linear feedback shift registers 341, 342 and 343 are given to the driving waveform generation circuits 31-1 to 31-N as correction data R1 to RN. Each of the correction data R1 to RN is assigned to the driving waveform generation circuits 31-1 to 31-N in the logic in which "the same output bit of a pseudo-random number does not overlap bits having the same weight of correction data to be input".

According to the fourth embodiment, the number of driving waveform generation circuits 31-1 to 31-N can be reduced to a half of the number of ejection channels ch. 1 to ch. 2N, and similar effect as in the first embodiment can be achieved.

In addition, in the fourth embodiment, the random number generation portion 34A of the first embodiment is employed as the random number generation portion 34D, and an embodiment is not limited thereto. The random number generation portion 34B of the second embodiment or the random number generation portion 34C of the third embodiment may be employed.

Fifth Embodiment

In the fourth embodiment, the ejection channels are divided into two groups, and are driven together for each group. The number of groups of the ejection channels is not limited to two.

Therefore, next, an embodiment in which plurality of ejection channels are divided into three groups and are driven together for each group will be described as a fifth embodiment.

Figure 19:
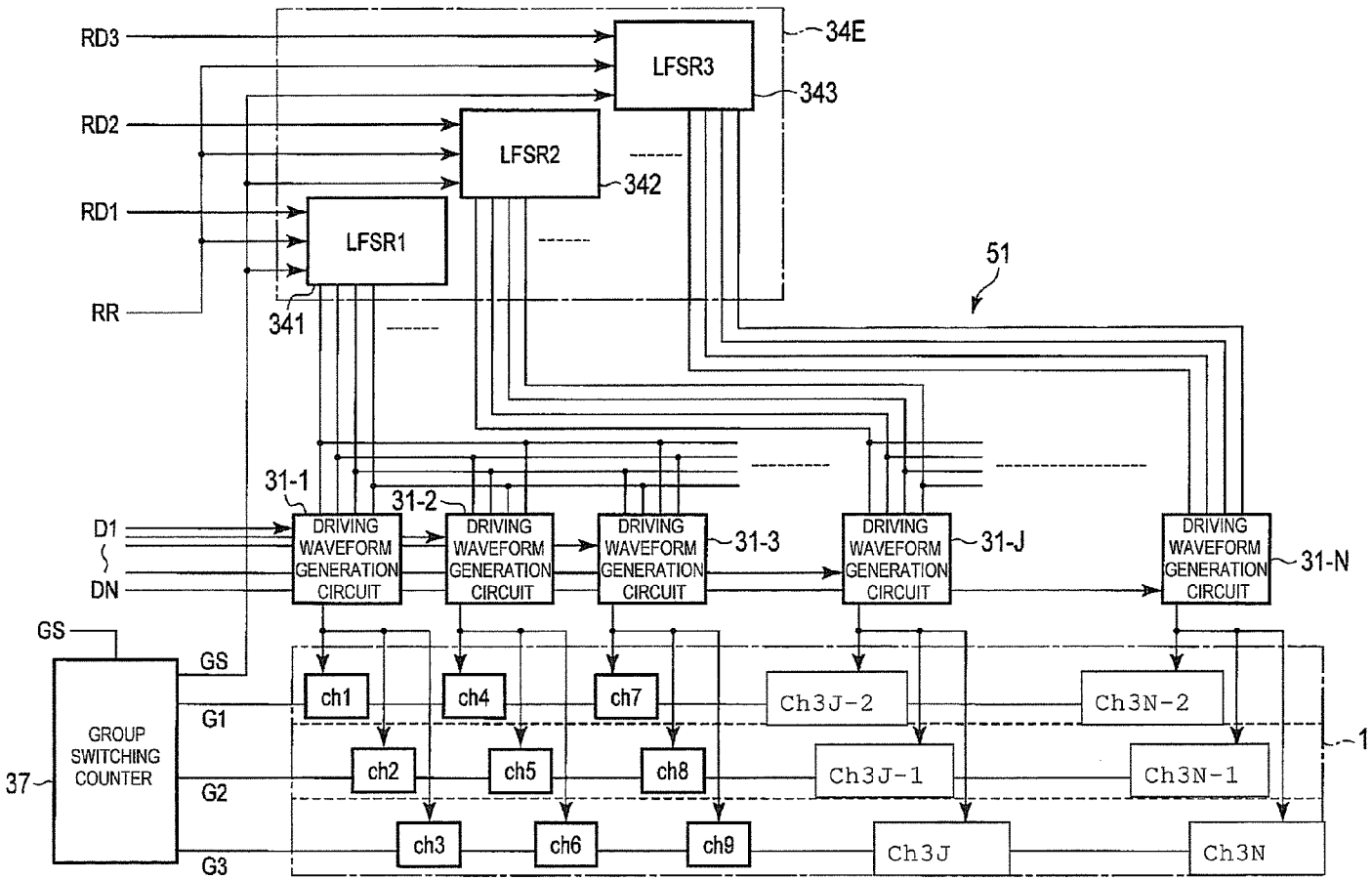
FIG. 19 is a configuration diagram of main elements according to a fifth embodiment.

FIG. 19 is a configuration diagram of main elements according to the fifth embodiment, and an element common to FIG. 4 described in the first embodiment is given the same reference numeral, and detailed description thereof will be omitted.

As shown in FIG. 19, the ejection channels ch. 1 to ch. 3N of the inkjet head 1 are divided into a first group, a second group, and a third group every other two in an arrangement direction thereof. In other words, the ejection channels ch. 1, ch. 4, ch. 7, . . . , ch. 3J-2, . . . , and ch. 3N-2 are included in the first group, the ejection channels ch. 2, ch. 5, ch. 8, ch. 3J-1, . . . , and ch. 3N-1 are included in the second group, and the ejection channels ch. 3, ch. 6, ch. 9, . . . , ch. 3J, . . . , and ch. 3N are included in the third group.

The driving waveform generation circuits 31-1 to 31-N are provided so as to respectively correspond to the ejection channels ch. 1, ch. 4, ch. 7, . . . , ch. 3J-2, . . . , and ch. 3N-2 included in the first group. In addition, driving pulse signals DP1 to DPN output from the respective driving waveform generation circuits 31-1 to 31-N are supplied in common to the corresponding ejection channels ch. 1, ch. 4, ch. 7, . . . , ch. 3J-2, . . . , and ch. 3N-2 of the first group, the ejection channels ch. 2, ch. 5, ch. 8, ch. 3J-1, . . . , and ch. 3N-1 of the second group adjacent to ejection channels ch. 1, ch. 4, ch. 7, . . . , ch. 3J-2, . . . , and ch. 3N-2, and the ejection channels ch. 3, ch. 6, ch. 9, . . . , ch. 3J, . . . , and ch. 3N of the third group further adjacent thereto in the same direction.

Among the ejection channels ch. 1 to ch. 3N, a first group selection signal GS1 is supplied to the ejection channels ch. 1, ch. 4, ch. 7, . . . , ch. 3J-2, . . . , and ch. 3N-2 included in the first group. A second group selection signal GS2 is supplied to the ejection channels ch. 2, ch. 5, ch. 8, ch. 3-1, . . . , and ch. 3N-1 included in the second group. A third group selection signal GS3 is supplied to the ejection channels ch. 3, ch. 6, ch. 9, . . . , ch. 3J, . . . , and ch. 3N included in the third group. The group selection signals GS1, GS2 and GS3 are output from a group switching counter 37.

The group switching counter 37 receives the group selection signal GS which is included in the control parameters CP and is supplied, and performs up-counting each time the signal GS is input. In addition, each time up-counting is performed, the first group selection signal GS1, the second group selection signal GS2, and the third group selection signal GS3 are sequentially output, and the first group selection signal GS1 is output again in the next up-counting. Further, the group switching counter 37 outputs the group selection signal GS to each of the linear feedback shift registers 341, 342 and 343 of a random number generation portion 34E described later.

The respective ejection channels ch. 1, ch. 4, ch. 7, . . . , ch. 3N-2, or, ch. 2, ch. 5, ch. 8, . . . , ch. 3N-1, or, ch. 3, ch. 6, ch. 9, . . . , ch. 3N receive the driving pulse signals DP1 to DPN while the group selection signals GS1, GS2 and GS3 are input thereto, and eject ink droplets in response to the driving pulse signals DP1 to DPN. In other words, the ejection channels ch. 1, ch. 4, ch. 7, . . . , ch. 3J-2, . . . , and ch. 3N-2 included in the first group are driven together, and the ejection channels ch. 2, ch. 3, ch. 5, ch. 6, ch. 8, ch. 3J-1, ch. 3J, . . . , ch. 3N-1, and ch. 3N included in the other groups are not driven during that time. This is also the same for the second and third groups.

The random number generation portion 34E is formed by a plurality of (in FIG. 18, three) independent linear feedback shift registers 341, 342 and 343 in the same manner as in the first embodiment. The linear feedback shift registers 341, 342 and 343 receive in common the group selection signal GS and a random number initialization signal RR, and receive initial value data RD1, RD2 and RD3, respectively.

The random number initialization signal RR and the initial value data RD1, RD2 and RD3 are given from the parameter storage portion 33. The group selection signal GS is given from the group switching counter 37.

When the group selection signal GS is input, the respective linear feedback shift registers 341, 342 and 343 generate a "m+1"-bit pseudo-random number called an M-sequence pulse on the basis of the initial value data RD1, RD2 and RD3. In other words, a value of a pseudo-random number generated by each of the linear feedback shift registers 341, 342 and 343 is updated each time the group selection signal GS is input thereto (random number updating portion). Therefore, a value of a pseudo-random number is updated each time the ejection channels ch. 1 to ch. 3N are driven for each group.

Respective bits b0 to bm of a pseudo-random number generated from each of the linear feedback shift registers 341, 342 and 343 are given to the driving waveform generation circuits 31-1 to 31-N as correction data R1 to RN. Each of the correction data R1 to RN is assigned to the driving waveform generation circuits 31-1 to 31-N in the logic in which "the same output bit of a pseudo-random number does not overlap bits having the same weight of correction data to be input".

According to the fifth embodiment, the number of driving waveform generation circuits 31-1 to 31-N can be reduced to a third of the number of ejection channels ch. 1 to ch. N, and similar effect as in the first embodiment can be achieved.

In addition, in the fifth embodiment, the random number generation portion 34A of the first embodiment is employed as the random number generation portion 34E, and an embodiment is not limited thereto. The random number generation portion 34B of the second embodiment or the random number generation portion 34C of the third embodiment may be employed.

Sixth Embodiment

In the first to fifth embodiments, values of pseudo-random numbers generated from the random number generation portions 34A to 34E are directly given to the driving waveform generation circuits 31-1 to 31-N as correction data R1 to RN. The respective driving waveform generation circuits 31-1 to 31-N changes a basic driving waveform of the driving pulse signals DP1 to DPN according to the printing data D1 to DN and the correction data R1 to RN so as to generate the driving pulse signals DP1 to DPN for the corresponding ejection channels ch. 1 to ch. N.

The control parameters CP include, for example, second correction data H1 to HN for efficiency of actuators corresponding to the respective ejection channels ch. 1 to ch. N as the parameters PA1 to PAx required in an operation of the ink jet head 1. The second correction data H1 to HN is a value for correcting density unevenness caused by efficiency of the actuator, and is generated for the respective ejection channels ch. 1 to ch. N. The density unevenness caused by efficiency of the actuator is corrected using the second correction data H1 to HN, and further a random small change occurs in a printing density by using the first correction data R1 to RN which is a value of a pseudo-random number generated from the random number generation portions 34A to 34E, thereby making the density unevenness more invisible. An embodiment in this case will be described as a sixth embodiment with reference to FIG. 20.

Figure 20:
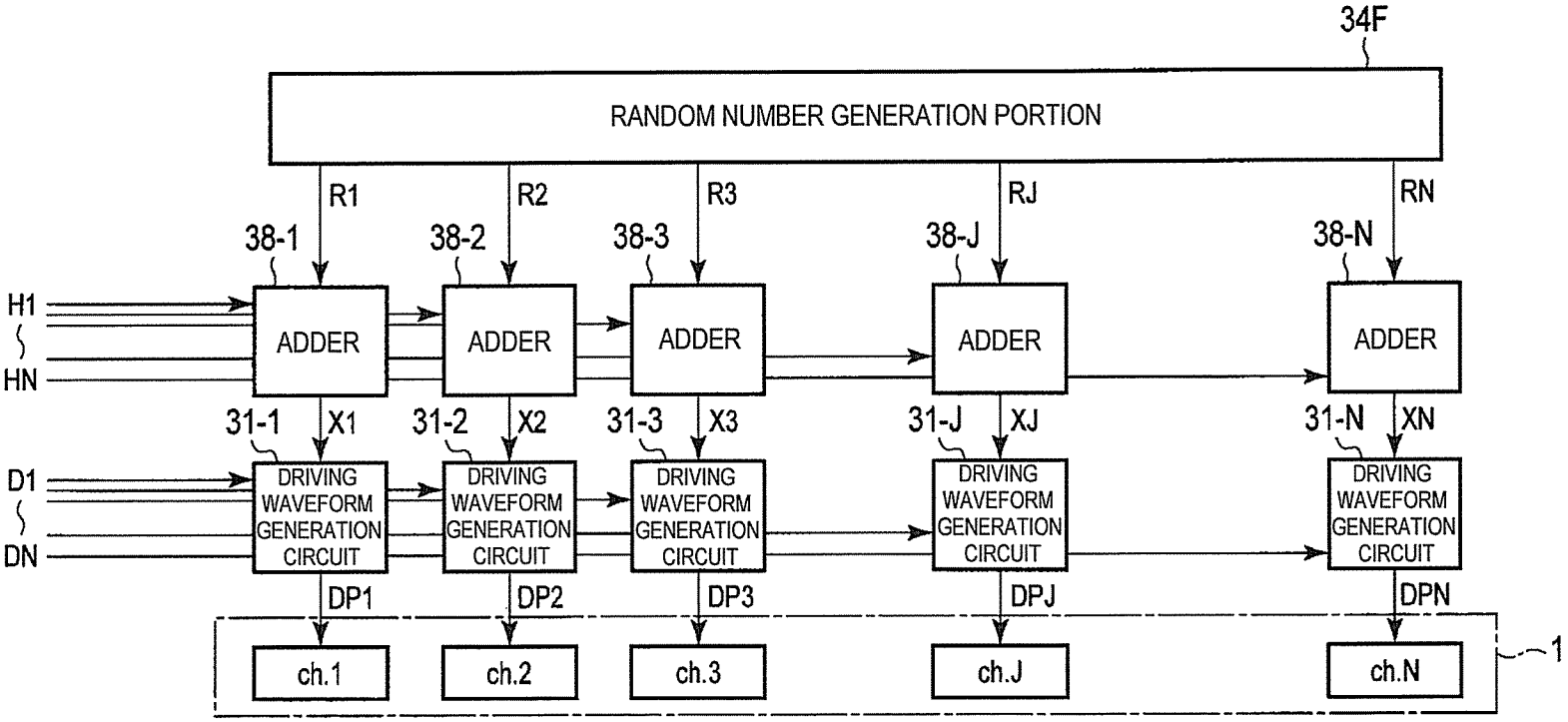
FIG. 20 is a configuration diagram of main elements according to a sixth embodiment.

In FIG. 20, a random number generation portion 34F may employ any configuration of the random number generation portions 34A to 34C used in the first to third embodiments. Alternatively, if the ejection channels ch. 1 to ch. N of the ink jet head 1 are divided into two or more groups and are driven together for each group, the random number generation portion 34D or 34E used in the fourth or fifth embodiment may be employed.

The first correction data R1 to RN including values of pseudo-random numbers is output to the respective driving waveform generation circuits 31-1 to 31-N corresponding to the ejection channels ch. 1 to ch. N from the random number generation portion 34F. The first correction data R1 to RN is given to a first input of each of adders 38-1 to 38-N which are adding portions provided so as to respectively correspond to the driving waveform generation circuits 31-1 to 31-N. The second correction data H1 to HN for efficiency of the actuators corresponding to the ejection channels ch. 1 to ch. N is given to a second input of each of the adders 38-1 to 38-N from the parameter storage portion 33.

Each of the adders 38-1 to 38-N combines the first correction data R1 to RN given to the first input with the second correction data H1 to HN given to the second input. In addition, the combined output is output to the corresponding driving waveform generation circuits 31-1 to 31-N as correction data X1 to XN.

The respective driving waveform generation circuits 31-1 to 31-N changes a basic driving waveform of the driving pulse signals DP1 to DPN according to the printing data D1 to DN and the correction data X1 to XN so as to generate the driving pulse signals DP1 to DPN for the corresponding ejection channels ch. 1 to ch. N. The respective ejection channels ch. 1 to ch. N receive the driving pulse signals DP1 to DPN and eject ink droplets according to the driving pulse signals DP1 to DPN.

According to the sixth embodiment, since density unevenness caused by efficiency of the actuator can be corrected, and a small change can be given to a printing density, the density unevenness can be made to be more invisible.

In addition, although, in the sixth embodiment, the second correction data H1 to HN is set to a value for correcting density unevenness caused by efficiency of the actuator, the second correction data H1 to HN is not limited thereto. For example, the second correction data H1 to HN may be set to a value for correcting density errors occurring depending on a printing pattern such as crosstalk, and the second correction data H1 to HN may be added to the first correction data R1 to RN generated from the random number generation portion 34F so as to be used as correction data X1 to XN for the driving waveform generation circuits 31-1 to 31-N.

In addition, the second correction data H1 to HN may be set to a value obtained by adding a value for correcting density unevenness caused by efficiency of the actuator to a value for correcting density errors occurring depending on a printing pattern such as crosstalk, and the second correction data H1 to HN may be added to the first correction data R1 to RN generated from the random number generation portion 34F so as to be used as correction data X1 to XN for the driving waveform generation circuits 31-1 to 31-N.

Other Embodiments

Although the random number generation portions 34A to 34F are included in the ink jet head driving device 30 which is inside the drive IC26 in the above-described respective embodiments, the random number generation portions 34A to 34F may be provided in the printing control portion 40 instead. Accordingly, a configuration of the ink jet head driving device 30 can be simplified. However, there is a problem in that an amount of information to be transmitted increases in lines which connect the printing control portion 40 to the ink jet head driving device 30. The random number generation portions 34A to 34F are provided in the ink jet head driving device 30 side, and thus this problem does not occur.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A driving device of an ink jet head including a plurality of ejection channels, comprising:

a plurality of driving waveform generation portions that are provided so as to respectively correspond to the plurality of ejection channels, receive printing data and correction data, generate a driving signal of the ejection channels on the basis of the received printing data, correct a waveform of the driving signal by using the received correction data, and output the corrected waveform to the corresponding ejection channels;

a random number generation portion that generates a pseudorandom number formed by a plurality of bits; and a connection portion that connects the random number generation portion to the respective driving waveform generation portions, wherein the connection portion connects the random number generation portion to the respective driving waveform generation portions such that the same bit of the pseudorandom number is supplied to bits having different weights of the correction data to be input to at least two driving waveform generation portions.

2. The device according to claim 1, wherein the connection portion connects the random number generation portion to the respective driving waveform generation portions with random manner.

3. The device according to claim 1, wherein the random number generation portion generates a pseudorandom number formed by a plurality of bits smaller than a total number of bits of correction data to be input to the respective driving waveform generation portions.

4. The device according to claim 1, wherein an ink jet head driving device in which a plurality of ejection channels included in an ink jet head are divided into two or more groups, and the ejection channels included in the same group are driven together, wherein a plurality of driving waveform generation portions are provided so as to respectively correspond to a plurality of ejection channels included in any one group among the plurality of ejection channels, correct a waveform of the driving signal by using the received correction data, and then output the corrected waveform to corresponding ejection channels, further comprising:

a pseudorandom number updating portion that updates a pseudorandom number generated by the random number generation portion each time the group of the ejection channels which are driven together is changed.

5. The device according to claim 1, further comprising:

a plurality of adding portions that are provided so as to respectively correspond to the driving waveform generation portions, and add second correction data related to the ejection channels to correction data from the connection portion, wherein correction data additional values obtained through the addition by the adding portions are respectively supplied to the corresponding driving waveform generation portions as correction data.

6. A driving device of an ink jet head including a plurality of ejection channels, comprising:

a plurality of driving waveform generation portions that are provided so as to respectively correspond to the plurality of ejection channels, receive printing data and correction data, generate a driving signal of the ejection channels on the basis of the received printing data, correct a waveform of the driving signal by using the received correction data, and then output the corrected waveform to the corresponding ejection channels;

a random number generation portion that generates a pseudorandom number formed by a plurality of bits; and a connection portion that connects the random number generation portion to the respective driving waveform generation portions, wherein the connection portion connects the random number generation portion to the respective driving waveform generation portions such that the same bit of the pseudorandom number does not overlap bits having the same weight of the correction data to be input to the respective driving waveform generation portions.

7. The device according to claim 6, wherein an ink jet head driving device in which a plurality of ejection channels included in an ink jet head are divided into two or more groups, and the ejection channels included in the same group are driven together, wherein a plurality of driving waveform generation portions are provided so as to respectively correspond to a plurality of ejection channels included in any one group among the plurality of ejection channels, correct a waveform of the driving signal by using the received correction data, and then output the corrected waveform to corresponding ejection channels, further comprising:

a pseudorandom number updating portion that updates a pseudorandom number generated by the random number generation portion each time the group of the ejection channels which are driven together is changed.

8. The device according to claim 6, further comprising:

a plurality of adding portions that are provided so as to respectively correspond to the driving waveform generation portions, and add second correction data related to the ejection channels to correction data from the connection portion, wherein correction data additional values obtained through the addition by the adding portions are respectively supplied to the corresponding driving waveform generation portions as correction data.

9. An ink jet recording apparatus comprising:

a plurality of ink jet heads each having a plurality of ejection channels;

a printing controller; and cable wires connecting between the ink jet heads and the printing controller, wherein the ink jet heads further comprising:

driving waveform generation portions giving driving waveform to the respective ejection channels, a random number generation portion that generates a pseudorandom number formed by a plurality of bits, an initializing portion which initializes the random number generation portion with an initial value, a data reception portion which receive printing data from the printing controller via the cable wires;

a connection portion that connects the random number generation portion to the respective driving waveform generation portions;

wherein the driving waveform generation portions change the driving waveform based on the received printing data and the pseudorandom number, and the connection portion connects the random number generation portion to the respective driving waveform generation portions such that the same bit of the pseudorandom number is supplied to bits having different weights of the correction data to be input to at least two driving waveform generation portions.

10. The device according to claim 9, wherein the initial values of at least two ink jet heads are different each other.

11. An ink jet recording apparatus according to claim 10, wherein the plurality of the ink jet heads are arranged in the direction of the nozzle arrangement of each ink jet heads, and the difference of the initial values of each ink jet heads prevents a cyclic regularity in a print density having cycle length of a nozzle width of the ink let heads.

12. An ink jet recording apparatus according to claim 10, wherein the plurality of the ink jet heads are arranged perpendicular to the direction of the nozzle arrangement of each ink jet heads, wherein the difference of the initial values of each ink jet heads prevents an emphasis in a print density unevenness caused by the pseudorandom number.

13. An ink jet recording apparatus according to claim 10, wherein the plurality of the ink jet heads are arranged perpendicular to the direction of the nozzle arrangement of each ink jet heads, wherein at least 2 of the ink jet heads ejects different colors, wherein the difference of the initial values of each ink jet heads prevents an emphasis in a color unevenness caused by the pseudorandom number.

14. A driving device of an ink jet head including a plurality of ejection channels, comprising:

a plurality of driving waveform generation portions that are provided so as to respectively correspond to the plurality of ejection channels, receive printing data and correction data, generate a driving signal of the ejection channels on the basis of the received printing data, correct a waveform of the driving signal by using the received correction data, and then output the corrected waveform to the corresponding ejection channels;

a linear feedback shift register that generates an M-sequence pulse;

a connection portion that connects the linear feedback shift register to the respective driving waveform generation portions, a zero detection portion that outputs a detection signal when higher k (where $0<k<m$) bits of an m-bit pseudorandom number of an M-sequence pulse generated by the linear feedback shift register are all zero; and a shift control portion that shifts the linear feedback shift register by k or more bits in response to reception of the detection signal.

15. An ink jet recording apparatus comprising:

an ink jet head including a plurality of ejection channels;

a printing controller which is structurally apart from the ink jet head; and cable wires connecting between the ink jet head and the printing controller, wherein the ink jet head further comprising:

a plurality of driving waveform generation portions that are provided so as to respectively correspond to the plurality of ejection channels, receive printing data and correction data, generate a driving signal of the ejection channels on the basis of the received printing data, correct a waveform of the driving signal by using the received correction data, and output the corrected waveform to the corresponding ejection channels;

a random number generation portion that generates a pseudorandom number formed by a plurality of bits; and a connection portion that connects the random number generation portion to the respective driving waveform generation portions, wherein the connection portion connects the random number generation portion to the respective driving waveform generation portions such that the same bit of the pseudorandom number is supplied to bits having different weights of the correction data to be input to at least two driving waveform generation portions.

* * * * *